US009221573B2

(12) United States Patent
Lorence et al.

(10) Patent No.: US 9,221,573 B2
(45) Date of Patent: Dec. 29, 2015

(54) LABEL APPLICATOR BELT SYSTEM

(75) Inventors: James P. Lorence, Painesville, OH (US); Richard Previty, Chardon, OH (US); Alan Green, Greenwood, SC (US); Frank B. Woznic, Newport Beach, CA (US); Craig W. Potter, Mentor, OH (US); Harry Worm, Pasadena, CA (US); Walt Sofie, Pasadena, CA (US)

(73) Assignee: Avery Dennison Corporation, Glendale, CA (US)

( * ) Notice: Subject to any disclaimer, the term of this patent is extended or adjusted under 35 U.S.C. 154(b) by 17 days.

(21) Appl. No.: 13/575,996

(22) PCT Filed: Jan. 21, 2011

(86) PCT No.: PCT/US2011/021968

§ 371 (c)(1),
(2), (4) Date: Jul. 30, 2012

(87) PCT Pub. No.: WO2011/094117

PCT Pub. Date: Aug. 4, 2011

(65) Prior Publication Data

US 2012/0318430 A1 Dec. 20, 2012

Related U.S. Application Data

(60) Provisional application No. 61/299,151, filed on Jan. 28, 2010.

(51) Int. Cl.
*B65C 9/34* (2006.01)
*B65C 9/04* (2006.01)

(52) U.S. Cl.
CPC ..... *B65C 9/34* (2013.01); *Y10T 156/10* (2015.01); *Y10T 156/17* (2015.01)

(58) Field of Classification Search
CPC ..... B65C 3/14; B65C 3/16; B65C 3/163; B65C 3/18; B65C 9/04
USPC ..... 156/84, 184–187, 189, DIG. 8–DIG. 13, 156/DIG. 36, DIG. 41, 212–215
See application file for complete search history.

(56) References Cited

U.S. PATENT DOCUMENTS 2,356,951 A 8/1944 Runton et al.
2,524,945 A * 10/1950 Von Hofe ..... 156/320

(Continued)

FOREIGN PATENT DOCUMENTS

CN 86106943 7/1987
CN 2154164 1/1994

(Continued)

OTHER PUBLICATIONS

Examiner's First Report on corresponding Australian Application No. 2008-237210 dated Jun. 28, 2011.

(Continued)

*Primary Examiner* — Carson Gross
(74) *Attorney, Agent, or Firm* — Avery Dennison Corporation

(57) ABSTRACT

A label applicator system is described comprising one or more, and preferably two, assemblies of rollers and belts. The assemblies are arranged relative to one another such that at least a portion of the belts of each assembly are aligned with one another to define an article receiving lane. The assemblies are arranged and configured such that the lane extends in a zig-zag path, a relatively straight path, and/or an arcuate path. Selection of the lane geometry along with appropriate control of belt velocities enable high rates of applying labels to articles and particularly containers having compound curves.

38 Claims, 7 Drawing Sheets

(56) References Cited

U.S. PATENT DOCUMENTS 2,873,040 A * 2/1959 Manas ..... 156/455
3,178,329 A * 4/1965 Rohbogner ..... 156/250
3,235,433 A 2/1966 Cvacko et al.
3,434,902 A 3/1969 Bliss
3,515,270 A 6/1970 Tonn et al.
3,586,580 A 6/1971 Dullinger
3,718,495 A 2/1973 Tomita
3,769,147 A 10/1973 Komendat et al.
3,779,829 A * 12/1973 Wolff ..... 156/361
3,802,942 A 4/1974 Amberg et al.
3,823,050 A 7/1974 La Mers
3,834,607 A 9/1974 Muylle
3,884,396 A 5/1975 Gordon et al.
3,908,827 A 9/1975 Bemmels et al.
3,923,198 A 12/1975 Brochman
3,928,115 A 12/1975 Kerwin
3,953,635 A 4/1976 Dunning
4,007,067 A 2/1977 Dunning
4,011,122 A 3/1977 Ashcroft
4,021,285 A 5/1977 Amberg
4,025,381 A 5/1977 Amberg
4,139,099 A 2/1979 Daly et al.
4,172,163 A 10/1979 Magnotta
4,188,249 A 2/1980 Fujio
4,198,560 A 4/1980 Dietrich
4,210,621 A 7/1980 Snover et al.
4,214,937 A 7/1980 Geurtsen et al.
4,217,263 A 8/1980 Magnotta
4,225,049 A 9/1980 Inoue
4,240,854 A 12/1980 Massey et al.
4,250,686 A 2/1981 Fujio
4,275,856 A 6/1981 Harvey
4,286,421 A 9/1981 Fujio
4,287,700 A 9/1981 Fujio
4,290,992 A 9/1981 Fujio
4,293,364 A 10/1981 Fujio
4,300,974 A 11/1981 Bauer
4,313,986 A 2/1982 Magnotta
4,343,856 A 8/1982 Goswami et al.
4,410,011 A 10/1983 Andrii et al.
4,427,744 A 1/1984 Hume, III
4,486,366 A 12/1984 Reddy
4,497,275 A 2/1985 Johnson et al.
4,511,425 A 4/1985 Boyd et al.
4,518,468 A 5/1985 Fotland et al.
4,536,434 A 8/1985 Magnotta
4,566,933 A 1/1986 Crankshaw et al.
4,585,679 A 4/1986 Karabedian
4,595,544 A 6/1986 Maruyama et al.
4,610,744 A 9/1986 Smith et al.
4,629,663 A 12/1986 Brown et al.
4,699,842 A 10/1987 Jorgensen et al.
4,714,515 A 12/1987 Hoffmann
4,726,865 A 2/1988 Treat
4,732,641 A 3/1988 Nechay et al.
4,735,664 A 4/1988 Asghar et al.
4,771,891 A 9/1988 Sorensen et al.
4,792,376 A 12/1988 Denley
4,801,348 A 1/1989 Takagaki
4,801,514 A 1/1989 Will et al.
4,822,631 A 4/1989 Beaudet
4,831,799 A 5/1989 Glover et al.
4,832,783 A 5/1989 Nechay et al.
4,835,217 A 5/1989 Jorgensen et al.
4,844,962 A 7/1989 May et al.
4,863,768 A 9/1989 Ishio et al.
4,871,553 A 10/1989 Huhndorff
4,872,931 A 10/1989 Mitchell
4,874,454 A 10/1989 Talalay et al.
4,874,665 A 10/1989 Doheny
4,875,962 A 10/1989 Breakspear
4,910,941 A 3/1990 Nagano et al.
4,911,994 A 3/1990 Will et al.
4,923,557 A 5/1990 Dickey
4,924,714 A 5/1990 Gross
4,950,344 A 8/1990 Glover et al.
4,956,963 A 9/1990 Johnson
4,961,978 A 10/1990 Doheny, Jr. et al.
4,963,418 A 10/1990 Isaka et al.
4,980,008 A 12/1990 Woods et al.
4,982,872 A 1/1991 Avery
4,983,238 A 1/1991 Yoshida et al.
4,997,239 A 3/1991 Crisp et al.
5,021,204 A 6/1991 Frost et al.
5,022,941 A 6/1991 Doheny, Jr. et al.
5,030,306 A 7/1991 Lastra
5,032,477 A 7/1991 Will et al.
5,043,204 A 8/1991 Itaba et al.
5,069,953 A 12/1991 Kishikawa et al.
5,070,680 A 12/1991 Nagano
5,071,167 A 12/1991 O'Brien
5,091,237 A 2/1992 Schloegl et al.
5,102,733 A 4/1992 Zawadzki
5,111,953 A 5/1992 Faust et al.
5,132,074 A 7/1992 Isozaki et al.
5,135,261 A 8/1992 Cusack et al.
5,143,570 A 9/1992 Freedman
5,145,728 A 9/1992 Itaba et al.
5,147,040 A 9/1992 Koike et al.
5,158,815 A 10/1992 Doheny, Jr. et al.
5,158,836 A 10/1992 Schirmer et al.
5,164,444 A 11/1992 Bernard
5,167,974 A 12/1992 Grindrod et al.
5,169,714 A 12/1992 Kondo et al.
5,173,266 A 12/1992 Kenney
5,176,948 A 1/1993 Nguyen et al.
5,183,841 A 2/1993 Bernard
5,186,782 A 2/1993 Freedman
5,187,235 A 2/1993 Bordoloi et al.
5,189,126 A 2/1993 Bernard
5,190,609 A 3/1993 Lin et al.
5,196,504 A 3/1993 Scholz et al.
5,212,009 A 5/1993 Peiffer et al.
5,219,666 A 6/1993 Schirmer et al.
5,221,706 A 6/1993 Lee et al.
5,223,315 A 6/1993 Katsura et al.
5,234,733 A 8/1993 Schloegl et al.
5,234,736 A 8/1993 Lee
5,240,529 A 8/1993 Hoffman
5,240,989 A 8/1993 Bernard et al.
5,242,650 A 9/1993 Rackovan et al.
5,245,456 A 9/1993 Yoshimi et al.
5,246,762 A 9/1993 Nakamura
5,252,155 A 10/1993 Nowicki et al.
5,262,216 A 11/1993 Popat et al.
5,262,251 A 11/1993 Will et al.
5,264,532 A 11/1993 Bernard
5,290,842 A 3/1994 Sasaki et al.
5,292,561 A 3/1994 Peiffer et al.
5,296,081 A 3/1994 Morin et al.
5,298,708 A 3/1994 Babu et al.
5,300,353 A 4/1994 Yoshimura et al.
5,302,402 A 4/1994 Dudenhoeffer et al.
5,306,549 A 4/1994 Isozaki et al.
5,312,712 A 5/1994 Will et al.
5,316,344 A 5/1994 Popat et al.
5,318,815 A 6/1994 Newing et al.
5,322,876 A 6/1994 Sasaki et al.
5,326,644 A 7/1994 Scholz et al.
5,326,654 A 7/1994 Will et al.
5,346,259 A 9/1994 Mocilnikar et al.
5,358,804 A 10/1994 Will et al.
5,366,575 A 11/1994 Staff et al.
5,376,394 A 12/1994 Dudenhoeffer et al.
5,383,568 A 1/1995 Tusick et al.
5,385,965 A 1/1995 Bernard et al.
5,395,478 A 3/1995 Sattler et al.
5,397,615 A 3/1995 Van Beersel et al.
5,403,416 A 4/1995 Bright et al.
5,403,454 A 4/1995 Taniguchi et al.
5,407,718 A 4/1995 Popat et al.
5,407,752 A 4/1995 Fukuzumi et al.
5,411,295 A 5/1995 Bates et al.
5,417,901 A 5/1995 Hartman et al.

(56) References Cited

U.S. PATENT DOCUMENTS 5,420,195 A 5/1995 Mayer et al.
5,421,932 A 6/1995 Fujio
5,428,209 A 6/1995 Babu et al.
5,443,765 A 8/1995 Yoshimura et al.
5,443,895 A 8/1995 Peiffer et al.
5,460,878 A 10/1995 Hostetter
5,466,499 A 11/1995 Takagi et al.
5,477,192 A 12/1995 Black et al.
5,478,422 A 12/1995 Bright et al.
5,490,658 A 2/1996 Coward et al.
5,491,017 A 2/1996 Todt
5,492,950 A 2/1996 Brown et al.
5,512,120 A 4/1996 Hinton et al.
5,516,393 A 5/1996 Freedman
5,536,787 A 7/1996 Scholz et al.
5,536,800 A 7/1996 Scholz et al.
5,544,770 A 8/1996 Travisano
5,558,913 A 9/1996 Sasaki et al.
5,563,205 A 10/1996 Mayer et al.
5,565,055 A 10/1996 Croci
5,585,193 A 12/1996 Josephy et al.
5,593,747 A 1/1997 Georgelos
5,597,654 A 1/1997 Scholz et al.
5,607,790 A 3/1997 Hughen et al.
5,614,333 A 3/1997 Hughen et al.
5,618,033 A 4/1997 Owen et al.
5,623,011 A 4/1997 Bernard
5,653,927 A 8/1997 Flynn et al.
5,663,228 A 9/1997 Sasaki et al.
5,665,443 A 9/1997 Hata et al.
5,683,774 A 11/1997 Faykish et al.
5,688,456 A 11/1997 Kuriu et al.
5,690,628 A 11/1997 Huskey et al.
5,691,043 A 11/1997 Keller et al.
5,705,551 A 1/1998 Sasaki et al.
5,709,770 A 1/1998 Asghar et al.
5,709,937 A 1/1998 Adams et al.
5,712,031 A 1/1998 Kelch et al.
5,713,567 A 2/1998 Owen et al.
5,718,958 A 2/1998 Scholz et al.
5,721,041 A 2/1998 Baratto
5,725,966 A 3/1998 Abe et al.
5,726,220 A 3/1998 Tokushige et al.
5,728,440 A 3/1998 Good
5,728,469 A 3/1998 Mann et al.
5,733,615 A 3/1998 Rackovan et al.
5,741,563 A 4/1998 Mehta et al.
5,747,192 A 5/1998 Hughen et al.
5,753,326 A 5/1998 Blackwelder
5,759,337 A 6/1998 Fujio et al.
5,759,675 A 6/1998 Hamada et al.
5,766,795 A 6/1998 Will et al.
5,806,153 A 9/1998 Dolan et al.
5,817,426 A 10/1998 Spada et al.
5,827,609 A 10/1998 Ercillo et al.
5,830,571 A 11/1998 Mann et al.
5,833,273 A 11/1998 Strenk et al.
5,843,362 A 12/1998 Yoshii et al.
5,843,549 A 12/1998 Mingus
5,846,451 A 12/1998 Nakano et al.
5,851,610 A 12/1998 Ristey et al.
5,851,615 A 12/1998 Kay
5,856,387 A 1/1999 Sasaki et al.
5,859,116 A 1/1999 Shih
5,865,331 A 2/1999 Jacobs
5,866,634 A 2/1999 Tokushige et al.
5,869,160 A 2/1999 Mason et al.
5,876,816 A 3/1999 Freedman
5,878,554 A 3/1999 Loree et al.
5,879,496 A * 3/1999 Bright et al. ..... 156/86
5,884,425 A 3/1999 Baldwin
5,891,537 A 4/1999 Yoshii et al.
5,892,892 A 4/1999 Popat et al.
5,897,722 A 4/1999 Bright
5,900,091 A 5/1999 Kenney
5,904,804 A 5/1999 Kouda et al.
5,904,973 A 5/1999 Coward et al.
5,908,694 A 6/1999 Makar et al.
5,914,165 A 6/1999 Freedman
5,925,432 A 7/1999 Kian et al.
5,935,730 A 8/1999 Will et al.
5,948,517 A 9/1999 Adamko et al.
5,952,122 A 9/1999 Shacklett, III
5,954,907 A 9/1999 LaRose et al.
5,961,766 A 10/1999 Chang et al.
5,972,444 A 10/1999 Patel et al.
5,976,691 A 11/1999 Noguchi et al.
5,982,284 A 11/1999 Baldwin et al.
5,985,075 A 11/1999 Freedman
5,990,400 A 11/1999 Hoshino et al.
5,993,961 A 11/1999 Ugolick et al.
5,998,018 A 12/1999 Murakami et al.
6,004,682 A 12/1999 Rackovan et al.
6,016,618 A 1/2000 Attia et al.
6,016,641 A 1/2000 Nagano
6,025,079 A 2/2000 Ciocca et al.
6,042,930 A * 3/2000 Kelch et al. ..... 428/195.1
6,070,750 A 6/2000 Kubitz
6,074,747 A 6/2000 Scholz et al.
6,083,338 A 7/2000 Scholz et al.
6,099,927 A 8/2000 Freedman
6,107,411 A 8/2000 Toya et al.
6,113,838 A 9/2000 Flynn et al.
6,113,996 A 9/2000 Amon et al.
6,127,024 A 10/2000 Weiss et al.
6,150,013 A 11/2000 Balaji et al.
6,156,252 A 12/2000 Freedman
6,165,609 A 12/2000 Curatolo
6,176,966 B1 1/2001 Tsujimoto et al.
6,183,862 B1 2/2001 Ko et al.
6,187,432 B1 2/2001 Krish et al.
6,194,501 B1 2/2001 Okada et al.
6,197,419 B1 3/2001 Hyde et al.
6,209,605 B1 4/2001 Lee et al.
6,210,524 B1 4/2001 Josephy
6,225,194 B1 5/2001 Noguchi et al.
6,228,486 B1 5/2001 Kittel et al.
6,231,958 B1 5/2001 Kim et al.
6,248,427 B1 6/2001 Ast
6,254,712 B1 7/2001 Enlow et al.
6,270,866 B1 8/2001 Okuda et al.
6,270,871 B1 8/2001 Scholz et al.
6,277,740 B1 8/2001 Goldstein
6,280,557 B1 8/2001 Peloquin et al.
6,284,337 B1 9/2001 Lorimor et al.
6,284,338 B1 9/2001 Bauman et al.
6,293,037 B1 9/2001 Spada et al.
6,294,111 B1 9/2001 Shacklett, III et al.
6,294,236 B1 9/2001 Freedman
6,296,129 B1 10/2001 Kawasaki
6,296,732 B1 10/2001 Enlow et al.
6,299,716 B1 10/2001 Bettinger
6,299,956 B1 10/2001 Freedman
6,299,975 B1 10/2001 Takahira et al.
6,312,800 B1 11/2001 Noguchi et al.
6,322,883 B1 11/2001 Williams
6,325,879 B1 12/2001 Heckman et al.
6,329,113 B1 12/2001 Bourdelais et al.
6,336,988 B1 1/2002 Enlow et al.
6,342,281 B2 1/2002 Hayakawa et al.
6,344,269 B1 2/2002 Makar et al.
6,352,768 B1 3/2002 Hseih et al.
6,358,587 B1 3/2002 Saint et al.
6,372,074 B1 4/2002 Holguin et al.
6,376,069 B1 4/2002 Bilodeau et al.
6,383,627 B2 5/2002 Hashimoto et al.
6,391,132 B1 * 5/2002 Kinnemann et al. ..... 156/64
RE37,764 E 6/2002 Good
6,398,892 B1 6/2002 Noguchi et al.
6,413,596 B1 7/2002 Okuda et al.
6,416,858 B1 7/2002 Ercillo et al.
6,417,307 B1 7/2002 Oi et al.
6,418,995 B1 7/2002 Sadrakula et al.
6,423,406 B1 7/2002 Bilodeau

(56) References Cited

U.S. PATENT DOCUMENTS 6,436,496 B1 8/2002 Rackovan et al.
6,436,501 B1 8/2002 Steadman
6,436,795 B2 8/2002 Noguchi et al.
6,461,555 B1 10/2002 Freedman
6,461,706 B1 10/2002 Freedman et al.
6,461,707 B1 10/2002 Scholz et al.
6,461,722 B1 10/2002 Kittel et al.
6,485,803 B1 11/2002 Bright
6,489,387 B2 12/2002 Mallya et al.
6,503,620 B1 1/2003 Xie et al.
6,509,087 B2 1/2003 Uehara et al.
6,524,669 B2 2/2003 Ito et al.
6,525,129 B1 2/2003 Su et al.
6,534,189 B1 3/2003 Burns et al.
6,540,865 B1 4/2003 Miekka et al.
6,541,098 B2 4/2003 Venkatasanthanam et al.
6,547,887 B1 4/2003 Ko et al.
6,547,912 B2 4/2003 Enlow et al.
6,553,700 B1 4/2003 Hirayama et al.
6,562,402 B2 5/2003 Scholz et al.
6,579,915 B2 6/2003 Kroll et al.
6,581,972 B2 6/2003 Nojima et al.
6,602,790 B2 8/2003 Kian et al.
6,616,727 B1 9/2003 Koyama et al.
6,627,283 B1 9/2003 Freedman
6,638,582 B1 10/2003 Uchiyama et al.
6,649,259 B1 11/2003 Hu et al.
6,663,928 B2 12/2003 Ito et al.
6,663,947 B2 12/2003 Freedman et al.
6,680,097 B1 1/2004 Amberger et al.
6,691,439 B1 2/2004 Miyashita et al.
6,698,958 B2 3/2004 Emery et al.
6,702,910 B2 3/2004 Noguchi et al.
6,706,355 B2 3/2004 Holguin et al.
6,709,761 B2 3/2004 Hirose et al.
6,716,501 B2 4/2004 Kovalchuk et al.
6,718,223 B1 4/2004 Iwakata et al.
6,720,085 B2 4/2004 Ito et al.
6,723,446 B2 4/2004 Seta et al.
6,726,969 B1 4/2004 Balaji et al.
6,727,970 B2 4/2004 Grace et al.
6,730,253 B2 5/2004 Etesse
6,733,609 B2 5/2004 Leonarda van Heck
6,733,870 B2 5/2004 Young et al.
6,748,994 B2 6/2004 Wien et al.
6,755,012 B2 6/2004 Frankefort
6,756,095 B2 6/2004 Sandt et al.
6,762,124 B2 7/2004 Kian et al.
6,765,070 B2 7/2004 Tamura et al.
6,773,804 B2 8/2004 Enlow et al.
6,774,036 B2 8/2004 Goldstein
6,780,765 B2 8/2004 Goldstein
6,786,376 B1 9/2004 Pitzen et al.
6,787,208 B2 9/2004 Galovic
6,796,352 B1 9/2004 Geurtsen et al.
6,808,776 B2 10/2004 Mientus et al.
6,808,822 B2 10/2004 Rajan et al.
6,821,592 B2 11/2004 Rodick
6,823,867 B2 11/2004 Avery et al.
6,824,001 B2 11/2004 Johnson et al.
6,824,839 B1 11/2004 Popat et al.
6,835,462 B2 12/2004 Sun et al.
6,841,261 B2 1/2005 Matsui et al.
6,844,391 B1 1/2005 Iyer et al.
6,846,531 B2 1/2005 Mientus et al.
6,855,406 B2 2/2005 Takayasu et al.
6,856,086 B2 2/2005 Grace et al.
6,867,983 B2 3/2005 Liu et al.
6,872,462 B2 3/2005 Roberts et al.
6,875,485 B2 4/2005 Kanai et al.
6,890,400 B2 5/2005 Scholz et al.
6,891,589 B2 5/2005 Hata et al.
6,897,151 B2 5/2005 Winter et al.
6,908,687 B2 6/2005 Mendes et al.
6,919,113 B2 7/2005 Therrian et al.
6,926,339 B2 8/2005 Gentile
6,926,959 B2 8/2005 Kroll et al.
6,932,135 B2 8/2005 Tabuchi
6,940,408 B2 9/2005 Ferguson et al.
6,951,596 B2 10/2005 Green et al.
6,989,418 B2 1/2006 Ko et al.
6,991,828 B2 1/2006 Husemann et al.
7,014,920 B2 3/2006 Kuriu
7,019,067 B2 3/2006 Holguin et al.
7,051,493 B2 5/2006 Cook et al.
7,079,204 B2 7/2006 Hata
7,093,362 B2 8/2006 Dallmeyer et al.
7,101,437 B2 9/2006 Boutilier et al.
7,105,226 B2 9/2006 Noguchi et al.
7,130,007 B2 10/2006 Hata et al.
7,138,703 B2 11/2006 Maida et al.
7,156,528 B2 1/2007 Weiss et al.
7,156,944 B2 1/2007 Moeller et al.
7,160,949 B2 1/2007 Ota et al.
7,165,888 B2 1/2007 Rodick
7,166,342 B2 1/2007 Hayakawa et al.
7,168,815 B2 1/2007 Shipman et al.
7,182,998 B2 2/2007 Takagi et al.
7,189,462 B2 3/2007 Matsui et al.
7,193,014 B2 3/2007 Wilkey et al.
7,195,822 B2 3/2007 Hiruma
7,215,839 B2 5/2007 Kawahara et al.
7,223,460 B2 5/2007 Kwok et al.
7,232,857 B2 6/2007 Hirasawa
7,236,222 B2 6/2007 Yoda et al.
7,247,389 B2 7/2007 Umeda
7,264,852 B2 9/2007 Koishi et al.
7,273,894 B2 9/2007 Shelby et al.
7,330,873 B2 2/2008 Yoshida et al.
7,344,765 B2 3/2008 Hayakawa et al.
7,351,767 B2 4/2008 Hartsock et al.
7,361,390 B2 4/2008 Yoda et al.
7,365,816 B2 4/2008 Kawai et al.
7,368,153 B2 5/2008 Barmore et al.
7,388,146 B2 6/2008 Fraas et al.
7,422,779 B2 9/2008 Van Rijn et al.
7,427,019 B2 9/2008 Haertel
D579,344 S 10/2008 Kunz
7,435,456 B2 10/2008 Nakamura et al.
7,473,473 B2 1/2009 Verrocchi
7,491,432 B2 2/2009 Kachi et al.
7,502,088 B2 3/2009 Suzuki et al.
7,525,463 B2 4/2009 Saunders et al.
7,588,807 B2 9/2009 Hayashi et al.
7,625,612 B2 12/2009 Ohmori et al.
7,638,203 B2 12/2009 Inagaki et al.
7,700,189 B2 4/2010 Amon et al.
7,709,417 B2 5/2010 Yukawa
7,727,620 B2 6/2010 Yamada et al.
7,749,584 B2 7/2010 Hayakawa et al.
7,758,938 B2 7/2010 Hseih et al.
7,846,517 B2 12/2010 McDaniel
2001/0007395 A1 7/2001 Gentile
2001/0014492 A1 8/2001 Noguchi et al.
2001/0014729 A1 8/2001 Hayakawa et al.
2001/0038920 A1 11/2001 Hashimoto et al.
2001/0050287 A1 12/2001 Namba et al.
2001/0052385 A1 12/2001 Enlow et al.
2002/0006723 A1 1/2002 Goldstein
2002/0007903 A1 1/2002 Enlow et al.
2002/0016381 A1 2/2002 Kroll et al.
2002/0025432 A1 2/2002 Noguchi et al.
2002/0045055 A1 4/2002 Ito et al.
2002/0056513 A1 5/2002 Tabuchi
2002/0064611 A1 5/2002 Kanai et al.
2002/0074078 A1 6/2002 Van Heck
2002/0090502 A1 7/2002 Ito et al.
2002/0098303 A1 7/2002 Rackovan et al.
2002/0098680 A1 7/2002 Goldstein
2002/0119294 A1 8/2002 Monkarsh et al.
2002/0124931 A1 9/2002 Etesse
2002/0136848 A1 9/2002 Yoshii et al.
2002/0150780 A1 10/2002 Ito et al.
2002/0153345 A1 10/2002 Johnson et al.

(56) References Cited

U.S. PATENT DOCUMENTS

2002/0157772 A1 10/2002 Enlow et al.
2002/0168453 A1 11/2002 McCutchan
2002/0186120 A1 12/2002 Tamura et al.
2002/0192412 A1 12/2002 Satani et al.
2002/0197499 A1 12/2002 Hirose et al.
2003/0029544 A1 2/2003 Noguchi et al.
2003/0031866 A1 2/2003 Noguchi et al.
2003/0039775 A1 2/2003 Kong
2003/0054164 A1 3/2003 Zimmermann et al.
2003/0054165 A1 3/2003 Yamanaka et al.
2003/0068453 A1 4/2003 Kong
2003/0092267 A1 5/2003 Kian et al.
2003/0102080 A1 6/2003 Mallik
2003/0134062 A1 7/2003 Rajan et al.
2003/0143415 A1 7/2003 Seta et al.
2003/0147042 A1 8/2003 Kawamoto et al.
2003/0152792 A1 8/2003 Takayasu et al.
2003/0157354 A1 8/2003 Van Veghel et al.
2003/0170427 A1 9/2003 Ito et al.
2003/0192541 A1 10/2003 Avery et al.
2003/0199604 A1 10/2003 Kroll et al.
2003/0201007 A1 10/2003 Fraas et al.
2003/0203166 A1 10/2003 Dronzek
2003/0218274 A1 11/2003 Boutilier et al.
2003/0222100 A1* 12/2003 Husband et al. ..... 222/105
2004/0010257 A1 1/2004 Cachia et al.
2004/0023488 A1 2/2004 Goldstein
2004/0028862 A1 2/2004 Burwell et al.
2004/0038012 A1 2/2004 Cook et al.
2004/0039775 A1 2/2004 Yoshida et al.
2004/0071962 A1 4/2004 Tanimoto
2004/0091625 A1 5/2004 Winter et al.
2004/0119922 A1 6/2004 Hata et al.
2004/0124661 A1 7/2004 Gentile
2004/0131806 A1 7/2004 Barmore et al.
2004/0142195 A1 7/2004 Roberts et al.
2004/0175520 A1 9/2004 Van Rijn et al.
2004/0180229 A1 9/2004 Hayakawa et al.
2004/0214142 A1 10/2004 Sutula, Jr.
2004/0258938 A1 12/2004 Yamanaka et al.
2004/0263731 A1 12/2004 Hata et al.
2004/0265361 A1 12/2004 Kuniya et al.
2005/0018328 A1 1/2005 Hata et al.
2005/0019514 A1 1/2005 Takegawa et al.
2005/0031860 A1 2/2005 Okada et al.
2005/0095379 A1 5/2005 Hayakawa et al.
2005/0100689 A1 5/2005 He et al.
2005/0106342 A1 5/2005 Dawes et al.
2005/0118406 A1 6/2005 Shelby et al.
2005/0119359 A1 6/2005 Shelby et al.
2005/0151230 A1 7/2005 Maida et al.
2005/0157389 A1 7/2005 Shipman et al.
2005/0157390 A1 7/2005 Weiss et al.
2005/0165164 A1 7/2005 Moeller et al.
2005/0187344 A1 8/2005 Wilkey et al.
2005/0191439 A1 9/2005 Hirose et al.
2005/0196563 A1 9/2005 Ito et al.
2005/0213320 A1 9/2005 Kazuhiro et al.
2005/0274687 A1 12/2005 McCutchan
2006/0019071 A1 1/2006 Akita
2006/0028601 A1 2/2006 Kawahara et al.
2006/0043169 A1 3/2006 Haertel
2006/0048417 A1 3/2006 Leykamm
2006/0057323 A1 3/2006 Yukawa et al.
2006/0062934 A1 3/2006 Hayashi et al.
2006/0066787 A1 3/2006 Yoda et al.
2006/0071826 A1 4/2006 Saunders et al.
2006/0072057 A1 4/2006 Yano et al.
2006/0077320 A1 4/2006 Hata et al.
2006/0089457 A1 4/2006 Hartsock et al.
2006/0115667 A1 6/2006 Verrocchi et al.
2006/0121219 A1 6/2006 Shelby et al.
2006/0132688 A1 6/2006 Yoda et al.
2006/0157438 A1* 7/2006 Livingston et al. ..... 215/381
2006/0159878 A1 7/2006 Wakai et al.
2006/0170848 A1 8/2006 Kawai et al.
2006/0177607 A1 8/2006 Ohmori et al.
2006/0177697 A1 8/2006 Kachi et al.
2006/0186581 A1 8/2006 Etesse et al.
2006/0215079 A1 9/2006 Suzuki et al.
2006/0216435 A1 9/2006 Nakamura
2006/0222874 A1 10/2006 Umeda
2006/0233984 A1 10/2006 Suzuki et al.
2006/0246231 A1 11/2006 Koishi et al.
2006/0275592 A1 12/2006 Tsuchida et al.
2006/0292104 A1 12/2006 Guskey et al.
2007/0004813 A1 1/2007 Shelby et al.
2007/0009732 A1 1/2007 Tsai et al.
2007/0043169 A1 2/2007 Kwok et al.
2007/0071967 A1 3/2007 Inagaki et al.
2007/0087191 A1 4/2007 Kaya et al.
2007/0099017 A1 5/2007 Hayakawa et al.
2007/0172669 A1 7/2007 Amon et al.
2007/0175574 A1 8/2007 Crank
2007/0212539 A1 9/2007 Yamada et al.
2007/0224345 A1 9/2007 Metz et al.
2007/0240806 A1 10/2007 Suzuki et al.
2007/0275319 A1 11/2007 He et al.
2007/0281137 A1 12/2007 Tsai et al.
2007/0289840 A1 12/2007 Ranger
2008/0017605 A1 1/2008 Zhang et al.
2008/0026170 A1 1/2008 Yamada et al.
2008/0050651 A1 2/2008 Wakai et al.
2008/0057236 A1 3/2008 Yamada et al.
2008/0185093 A1 8/2008 Ward et al.
2008/0289986 A1 11/2008 Goto et al.
2008/0314909 A1 12/2008 Takeo et al.
2009/0022916 A1 1/2009 Yamada et al.
2009/0038736 A1 2/2009 Lorence et al.
2009/0038737 A1 2/2009 Lorence et al.
2009/0042024 A1 2/2009 Fujii et al.
2009/0142456 A1 6/2009 Segal et al.
2009/0202757 A1 8/2009 Fujio
2009/0278187 A1 11/2009 Toba
2009/0313427 A1 12/2009 Ukai et al.
2010/0051200 A1 3/2010 Mueller et al.
2010/0112263 A1 5/2010 Lorence et al.
2010/0307692 A1 12/2010 Lorence et al.
2011/0198024 A1 8/2011 Lorence et al.
2012/0118503 A1 5/2012 Lorence et al.
2013/0022797 A1 1/2013 Lorence et al.
2014/0048196 A1 2/2014 Lorence et al.
2014/0129184 A1 5/2014 Mehrabi et al.
2015/0191632 A1 7/2015 Lorence et al.

FOREIGN PATENT DOCUMENTS

DE 1786009 11/1971
DE 2362108 * 6/1975
DE 2627312 12/1977
DE 2362108 9/1983
DE 8618893 12/1986
DE 8702448 4/1987
DE 3543317 6/1987
DE 19642110 4/1998
DE 10106383 8/2002
DE 102004004827 9/2005
EP 0019718 12/1980
EP 0050702 3/1981
EP 0060667 9/1982
EP 0121371 10/1984
EP 0187044 7/1986
EP 0208261 7/1986
EP 0189986 8/1986
EP 0210646 2/1987
EP 0313406 4/1989
EP 0317499 5/1989
EP 0319258 6/1989
EP 0326039 8/1989
EP 0340579 11/1989
EP 0342854 11/1989
EP 0395585 10/1990
EP 0400456 12/1990
EP 0261923 5/1991

(56) References Cited

FOREIGN PATENT DOCUMENTS

| | | |
|---|---|---|
| EP | 0445445 | 9/1991 |
| EP | 0447636 | 9/1991 |
| EP | 0448400 | 9/1991 |
| EP | 0454333 | 10/1991 |
| EP | 0456890 | 11/1991 |
| EP | 0460672 | 12/1991 |
| EP | 0477944 | 4/1992 |
| EP | 0482620 | 4/1992 |
| EP | 0510213 | 10/1992 |
| EP | 0588456 | 3/1994 |
| EP | 0220885 | 5/1994 |
| EP | 0478868 | 5/1994 |
| EP | 0621310 | 10/1994 |
| EP | 0628598 | 12/1994 |
| EP | 0663285 | 7/1995 |
| EP | 0664534 | 7/1995 |
| EP | 0667300 | 8/1995 |
| EP | 0486690 | 11/1995 |
| EP | 0688720 | 12/1995 |
| EP | 0570512 | 1/1996 |
| EP | 0698424 | 2/1996 |
| EP | 0575333 | 4/1996 |
| EP | 0730944 | 9/1996 |
| EP | 0733459 | 9/1996 |
| EP | 0582242 | 10/1996 |
| EP | 0616716 | 3/1997 |
| EP | 0772521 | 5/1997 |
| EP | 0779911 | 6/1997 |
| EP | 0805110 | 11/1997 |
| EP | 0578750 | 6/1998 |
| EP | 0852240 | 7/1998 |
| EP | 0812450 | 10/1998 |
| EP | 0884766 | 12/1998 |
| EP | 0930322 | 7/1999 |
| EP | 0930329 | 7/1999 |
| EP | 0785869 | 8/1999 |
| EP | 0959447 | 11/1999 |
| EP | 0963292 | 12/1999 |
| EP | 0979722 | 2/2000 |
| EP | 0983138 | 3/2000 |
| EP | 0989162 | 3/2000 |
| EP | 0999250 | 5/2000 |
| EP | 1019290 | 7/2000 |
| EP | 1024162 | 8/2000 |
| EP | 1043360 | 10/2000 |
| EP | 1055721 | 11/2000 |
| EP | 1072632 | 1/2001 |
| EP | 0675806 | 2/2001 |
| EP | 0858395 | 2/2001 |
| EP | 1074593 | 2/2001 |
| EP | 1083014 | 3/2001 |
| EP | 1083129 | 3/2001 |
| EP | 0891255 | 6/2001 |
| EP | 1107214 | 6/2001 |
| EP | 1116667 | 7/2001 |
| EP | 1120352 | 8/2001 |
| EP | 1122776 | 8/2001 |
| EP | 1124214 | 8/2001 |
| EP | 1145846 | 10/2001 |
| EP | 1151847 | 11/2001 |
| EP | 1157943 | 11/2001 |
| EP | 1160272 | 12/2001 |
| EP | 1172782 | 1/2002 |
| EP | 1176100 | 1/2002 |
| EP | 1184167 | 3/2002 |
| EP | 1201585 | 5/2002 |
| EP | 1205193 | 5/2002 |
| EP | 1205194 | 5/2002 |
| EP | 1205195 | 5/2002 |
| EP | 1227119 | 7/2002 |
| EP | 1234854 | 8/2002 |
| EP | 1238916 | 9/2002 |
| EP | 1262523 | 12/2002 |
| EP | 1270203 | 1/2003 |
| EP | 1270652 | 1/2003 |
| EP | 1270664 | 1/2003 |
| EP | 1275670 | 1/2003 |
| EP | 1299293 | 4/2003 |
| EP | 1304219 | 4/2003 |
| EP | 0932654 | 5/2003 |
| EP | 0831994 | 8/2003 |
| EP | 1333043 | 8/2003 |
| EP | 1336641 | 8/2003 |
| EP | 1340609 | 9/2003 |
| EP | 1361260 | 11/2003 |
| EP | 1391294 | 2/2004 |
| EP | 1118885 | 3/2004 |
| EP | 1398360 | 3/2004 |
| EP | 1179563 | 5/2004 |
| EP | 1418042 | 5/2004 |
| EP | 1426165 | 6/2004 |
| EP | 1431782 | 6/2004 |
| EP | 1460101 | 9/2004 |
| EP | 1464994 | 10/2004 |
| EP | 1464995 | 10/2004 |
| EP | 1489437 | 12/2004 |
| EP | 1491219 | 12/2004 |
| EP | 1491581 | 12/2004 |
| EP | 1491585 | 12/2004 |
| EP | 1505136 | 2/2005 |
| EP | 1288249 | 3/2005 |
| EP | 1420951 | 3/2005 |
| EP | 1514680 | 3/2005 |
| EP | 1538554 | 6/2005 |
| EP | 1550690 | 7/2005 |
| EP | 1566261 | 8/2005 |
| EP | 1571639 | 9/2005 |
| EP | 1616695 | 1/2006 |
| EP | 1368442 | 2/2006 |
| EP | 1632343 | 3/2006 |
| EP | 1084815 | 4/2006 |
| EP | 1646023 | 4/2006 |
| EP | 1647847 | 4/2006 |
| EP | 1525572 | 5/2006 |
| EP | 1659425 | 5/2006 |
| EP | 1661536 | 5/2006 |
| EP | 1467857 | 6/2006 |
| EP | 1684255 | 7/2006 |
| EP | 1688233 | 8/2006 |
| EP | 1695818 | 8/2006 |
| EP | 1698461 | 9/2006 |
| EP | 1712352 | 10/2006 |
| EP | 1714912 | 10/2006 |
| EP | 1723038 | 11/2006 |
| EP | 1724740 | 11/2006 |
| EP | 1733874 | 12/2006 |
| EP | 1737912 | 1/2007 |
| EP | 1747882 | 1/2007 |
| EP | 1752285 | 2/2007 |
| EP | 0854890 | 6/2007 |
| EP | 1810822 | 7/2007 |
| EP | 1839849 | 10/2007 |
| EP | 1862517 | 12/2007 |
| EP | 1876019 | 1/2008 |
| EP | 1915418 | 4/2008 |
| EP | 1537175 | 5/2008 |
| EP | 1692226 | 6/2009 |
| EP | 1692217 | 5/2010 |
| ES | 2159976 | 10/2001 |
| FR | 1187382 | 9/1959 |
| FR | 2007335 | 1/1970 |
| FR | 2164680 | 8/1973 |
| FR | 2581621 | 11/1986 |
| GB | 2023061 | 12/1979 |
| GB | 2142900 | 1/1985 |
| GB | 2204048 | 11/1988 |
| GB | 2310398 | 8/2007 |
| GB | 2488666 | 9/2012 |
| JP | 45-12936 | 5/1970 |
| JP | 52-115855 | 9/1977 |
| JP | 52115855 | 9/1977 |
| JP | 55044846 | 3/1980 |
| JP | 56078932 | 6/1981 |
| JP | 57025349 | 2/1982 |

(56) References Cited

FOREIGN PATENT DOCUMENTS

| | | |
|---|---|---|
| JP | 57034921 | 2/1982 |
| JP | 58005355 | 1/1983 |
| JP | 58118207 | 7/1983 |
| JP | 58185230 | 10/1983 |
| JP | 59-097175 | 6/1984 |
| JP | 59145114 | 8/1984 |
| JP | 60-099826 | 6/1985 |
| JP | 60219030 | 11/1985 |
| JP | 62014687 | 1/1987 |
| JP | 62-286726 | 12/1987 |
| JP | 63122518 | 5/1988 |
| JP | 63-049702 | 10/1988 |
| JP | 63-268743 | 11/1988 |
| JP | 63-272680 | 11/1988 |
| JP | 63272680 | 11/1988 |
| JP | 11-68426 | 7/1989 |
| JP | 2019230 | 1/1990 |
| JP | 3-114868 | 5/1991 |
| JP | 1991-187826 | 8/1991 |
| JP | 4-041902 | 2/1992 |
| JP | 4-161324 | 6/1992 |
| JP | 4-339652 | 11/1992 |
| JP | 5-092548 | 4/1993 |
| JP | 5-305664 | 11/1993 |
| JP | 6-122152 | 5/1994 |
| JP | 6122152 A | 5/1994 |
| JP | 62-91555 | 10/1994 |
| JP | 63-49702 | 12/1994 |
| JP | 7-165945 | 6/1995 |
| JP | 8-323859 | 12/1996 |
| JP | 9-239833 | 9/1997 |
| JP | 9-254257 | 9/1997 |
| JP | 9-272182 | 10/1997 |
| JP | 10-007168 | 1/1998 |
| JP | 10-020788 | 1/1998 |
| JP | 10-059412 | 3/1998 |
| JP | 10-095454 | 4/1998 |
| JP | 10-095470 | 4/1998 |
| JP | 10-194328 | 7/1998 |
| JP | 10-254364 | 9/1998 |
| JP | 10-209771 | 11/1998 |
| JP | 10-291252 | 11/1998 |
| JP | 10-305867 | 11/1998 |
| JP | 10-333577 | 12/1998 |
| JP | 10-337796 | 12/1998 |
| JP | 63-317493 | 12/1998 |
| JP | 11-079210 | 3/1999 |
| JP | 11-115133 | 4/1999 |
| JP | 11-158241 | 6/1999 |
| JP | 11-208667 | 8/1999 |
| JP | 11-224049 | 8/1999 |
| JP | 11-272172 | 10/1999 |
| JP | 11-292135 | 10/1999 |
| JP | 11-338356 | 12/1999 |
| JP | 2000-025112 | 1/2000 |
| JP | 2000-029392 | 1/2000 |
| JP | 2000-043156 | 2/2000 |
| JP | 2000-047770 | 2/2000 |
| JP | 2000-053154 | 2/2000 |
| JP | 2000-056689 | 2/2000 |
| JP | 2000-057399 | 2/2000 |
| JP | 2000-142791 | 5/2000 |
| JP | 2000-177763 | 6/2000 |
| JP | 2000-212527 | 8/2000 |
| JP | 2000-229357 | 8/2000 |
| JP | 2000-305460 | 11/2000 |
| JP | 2000-305461 | 11/2000 |
| JP | 2000-313754 | 11/2000 |
| JP | 2000-326934 | 11/2000 |
| JP | 2000-335658 | 12/2000 |
| JP | 2000-343139 | 12/2000 |
| JP | 2001-002014 | 1/2001 |
| JP | 2001-004678 | 1/2001 |
| JP | 2001-010663 | 1/2001 |
| JP | 2001-019017 | 1/2001 |
| JP | 2001-051601 | 2/2001 |
| JP | 2001-082868 | 3/2001 |
| JP | 2001-088839 | 4/2001 |
| JP | 2001-125489 | 5/2001 |
| JP | 2001-145985 | 5/2001 |
| JP | 2001-154587 | 6/2001 |
| JP | 2001-158408 | 6/2001 |
| JP | 2001-171620 | 6/2001 |
| JP | 2001-175179 | 6/2001 |
| JP | 2001-180622 | 7/2001 |
| JP | 2001-188476 | 7/2001 |
| JP | 2001-196033 | 7/2001 |
| JP | 2001-206379 | 7/2001 |
| JP | 2001-206407 | 7/2001 |
| JP | 2001-215880 | 8/2001 |
| JP | 2001-219961 | 8/2001 |
| JP | 2001-225855 | 8/2001 |
| JP | 2001-236019 | 8/2001 |
| JP | 2001-247652 | 9/2001 |
| JP | 2001-266806 | 9/2001 |
| JP | 2001-271022 | 10/2001 |
| JP | 2001-272915 | 10/2001 |
| JP | 2001-290425 | 10/2001 |
| JP | 2001-294282 | 10/2001 |
| JP | 2001-296805 | 10/2001 |
| JP | 2001-315260 | 11/2001 |
| JP | 2000-347571 | 12/2001 |
| JP | 2001-341773 | 12/2001 |
| JP | 2001-350411 | 12/2001 |
| JP | 2002-001878 | 1/2002 |
| JP | 2002-020705 | 1/2002 |
| JP | 2002-032024 | 1/2002 |
| JP | 2002-036356 | 2/2002 |
| JP | 2002-046715 | 2/2002 |
| JP | 2002-047358 | 2/2002 |
| JP | 2002-059969 | 2/2002 |
| JP | 2002-068150 | 3/2002 |
| JP | 2002-072890 | 3/2002 |
| JP | 2002-080074 | 3/2002 |
| JP | 2002-087432 | 3/2002 |
| JP | 2002-096863 | 4/2002 |
| JP | 2002-120862 | 4/2002 |
| JP | 2002-128133 | 5/2002 |
| JP | 2002-132159 | 5/2002 |
| JP | 2002-154506 | 5/2002 |
| JP | 2002-160710 | 6/2002 |
| JP | 2002-193235 | 7/2002 |
| JP | 2002-193321 | 7/2002 |
| JP | 2002-196677 | 7/2002 |
| JP | 2002-203525 | 7/2002 |
| JP | 2002-205712 | 7/2002 |
| JP | 2002-205713 | 7/2002 |
| JP | 2002-215044 | 7/2002 |
| JP | 2002-253894 | 9/2002 |
| JP | 2002-208228 | 10/2002 |
| JP | 2002-284173 | 10/2002 |
| JP | 2002-294392 | 10/2002 |
| JP | 2002-308228 | 10/2002 |
| JP | 2002-308240 | 10/2002 |
| JP | 2002-309202 | 10/2002 |
| JP | 2002-316360 | 10/2002 |
| JP | 2002-326613 | 11/2002 |
| JP | 2002-332016 | 11/2002 |
| JP | 2002-337880 | 11/2002 |
| JP | 2002-337941 | 11/2002 |
| JP | 2002-351333 | 12/2002 |
| JP | 2002-361741 | 12/2002 |
| JP | 2003-020013 | 1/2003 |
| JP | 2003-020014 | 1/2003 |
| JP | 2003-026127 | 1/2003 |
| JP | 2003-029638 | 1/2003 |
| JP | 2003-034369 | 2/2003 |
| JP | 2003-040219 | 2/2003 |
| JP | 2003-043922 | 2/2003 |
| JP | 2003-049131 | 2/2003 |
| JP | 2003-054520 | 2/2003 |
| JP | 2003-054561 | 2/2003 |
| JP | 2003-058057 | 2/2003 |
| JP | 2003-063536 | 3/2003 |

(56) References Cited

FOREIGN PATENT DOCUMENTS

| | | |
|---|---|---|
| JP | 2003-095225 | 4/2003 |
| JP | 2003-104330 | 4/2003 |
| JP | 2003-128021 | 5/2003 |
| JP | 2003-165512 | 6/2003 |
| JP | 2003-166133 | 6/2003 |
| JP | 2003-175964 | 6/2003 |
| JP | 2003-200528 | 7/2003 |
| JP | 2003-200529 | 7/2003 |
| JP | 2003-205946 | 7/2003 |
| JP | 2003-252384 | 9/2003 |
| JP | 2003-255839 | 9/2003 |
| JP | 2003-261171 | 9/2003 |
| JP | 2003-267437 | 9/2003 |
| JP | 2003-271062 | 9/2003 |
| JP | 2003-280528 | 10/2003 |
| JP | 2003-292029 | 10/2003 |
| JP | 2003-300516 | 10/2003 |
| JP | 2003-305771 | 10/2003 |
| JP | 2003-312723 | 11/2003 |
| JP | 2003-321055 | 11/2003 |
| JP | 2003-335343 | 11/2003 |
| JP | 2004-067117 | 3/2004 |
| JP | 2004-067189 | 3/2004 |
| JP | 2004-106848 | 4/2004 |
| JP | 2004-122385 | 4/2004 |
| JP | 2004-123213 | 4/2004 |
| JP | 2004-147360 | 5/2004 |
| JP | 2004-168350 | 6/2004 |
| JP | 2004-170468 | 6/2004 |
| JP | 2004-170469 | 6/2004 |
| JP | 2004-170715 | 6/2004 |
| JP | 2004-196918 | 7/2004 |
| JP | 2004-249706 | 9/2004 |
| JP | 2004-256143 | 9/2004 |
| JP | 2004-258115 | 9/2004 |
| JP | 2004-302125 | 10/2004 |
| JP | 2004-354743 | 12/2004 |
| JP | 2005-001729 | 1/2005 |
| JP | 2005-004017 | 1/2005 |
| JP | 2005-015030 | 1/2005 |
| JP | 2005-022089 | 1/2005 |
| JP | 2005-029216 | 2/2005 |
| JP | 2005-035238 | 2/2005 |
| JP | 2005-041552 | 2/2005 |
| JP | 2005-041891 | 2/2005 |
| JP | 2005-070066 | 3/2005 |
| JP | 2005-070739 | 3/2005 |
| JP | 2005-077677 | 3/2005 |
| JP | 2005-082225 | 3/2005 |
| JP | 2005-098900 | 4/2005 |
| JP | 2005-132453 | 5/2005 |
| JP | 2005-139423 | 6/2005 |
| JP | 2005-148331 | 6/2005 |
| JP | 2005-162262 | 6/2005 |
| JP | 2005-173611 | 6/2005 |
| JP | 2005-178886 | 7/2005 |
| JP | 2005-183093 | 7/2005 |
| JP | 2005-186991 | 7/2005 |
| JP | 2005-193984 | 7/2005 |
| JP | 2005-196151 | 7/2005 |
| JP | 2005-212226 | 8/2005 |
| JP | 2005-219767 | 8/2005 |
| JP | 2005-221982 | 8/2005 |
| JP | 2005-239246 | 9/2005 |
| JP | 2005-239948 | 9/2005 |
| JP | 2005-266592 | 9/2005 |
| JP | 2005-280727 | 10/2005 |
| JP | 2005-280782 | 10/2005 |
| JP | 2005-280789 | 10/2005 |
| JP | 2005-283738 | 10/2005 |
| JP | 2000-318105 | 11/2005 |
| JP | 2005-313944 | 11/2005 |
| JP | 2005-335764 | 12/2005 |
| JP | 2005-338304 | 12/2005 |
| JP | 2006-001573 | 1/2006 |
| JP | 2006-027641 | 2/2006 |
| JP | 2006-044797 | 2/2006 |
| JP | 2006-047499 | 2/2006 |
| JP | 2006-056552 | 3/2006 |
| JP | 2006-063139 | 3/2006 |
| JP | 2006-116874 | 5/2006 |
| JP | 2006-151479 | 6/2006 |
| JP | 2006-156755 | 6/2006 |
| JP | 2006-159901 | 6/2006 |
| JP | 2006-160796 | 6/2006 |
| JP | 2006-168753 | 6/2006 |
| JP | 2006-169285 | 6/2006 |
| JP | 2006-193215 | 7/2006 |
| JP | 2006-201534 | 8/2006 |
| JP | 2006-213341 | 8/2006 |
| JP | 2006-215245 | 8/2006 |
| JP | 2006-225009 | 8/2006 |
| JP | 2006-240697 | 9/2006 |
| JP | 2006-240721 | 9/2006 |
| JP | 2006-248539 | 9/2006 |
| JP | 2006-256665 | 9/2006 |
| JP | 2006-281584 | 10/2006 |
| JP | 2006-282246 | 10/2006 |
| JP | 2006-337635 | 12/2006 |
| JP | 2006-349749 | 12/2006 |
| JP | 2007-025174 | 2/2007 |
| JP | 2007-112719 | 5/2007 |
| JP | 2007-156928 | 6/2007 |
| JP | 2007-156930 | 6/2007 |
| JP | 2007-160543 | 6/2007 |
| JP | 2007-160544 | 6/2007 |
| JP | 2007-191606 | 8/2007 |
| JP | 2007-242248 | 9/2007 |
| JP | 2007-291342 | 11/2007 |
| JP | 2007-308165 | 11/2007 |
| JP | 2007-311527 | 11/2007 |
| JP | 2007-334086 | 12/2007 |
| JP | 2008-022250 | 1/2008 |
| JP | 2008-106252 | 5/2008 |
| JP | 2009-058687 | 3/2009 |
| JP | 2009-058722 | 3/2009 |
| JP | 2009-066966 | 4/2009 |
| JP | 2009-114380 | 5/2009 |
| JP | 2009-272564 | 11/2009 |
| JP | 2009-301393 | 12/2009 |
| JP | 2010-070247 | * 4/2010 |
| NL | 1032392 | 3/2008 |
| WO | WO 90/05672 | 5/1990 |
| WO | WO 92/08611 | 5/1992 |
| WO | WO 92/11997 | 7/1992 |
| WO | WO 92/13923 | 8/1992 |
| WO | WO 92/17306 | 10/1992 |
| WO | WO 93/01251 | 1/1993 |
| WO | WO 94/14611 | 7/1994 |
| WO | WO 95/15461 | 6/1995 |
| WO | WO 95/21775 | 8/1995 |
| WO | WO 96/02386 | 2/1996 |
| WO | WO 96/07699 | 3/1996 |
| WO | WO 96/10274 | 4/1996 |
| WO | WO 96/11804 | 4/1996 |
| WO | WO 96/27178 | 9/1996 |
| WO | WO 96/33864 | 10/1996 |
| WO | WO 96/42115 | 12/1996 |
| WO | WO 97/07490 | 2/1997 |
| WO | WO 97/11115 | 3/1997 |
| WO | WO 97/13645 | 4/1997 |
| WO | WO 97/14558 | 4/1997 |
| WO | WO 97/29523 | 8/1997 |
| WO | WO 97/31076 | 8/1997 |
| WO | WO 97/35719 | 10/1997 |
| WO | WO 98/14825 | 4/1998 |
| WO | WO 98/32786 | 7/1998 |
| WO | WO 98/52742 | 11/1998 |
| WO | WO 98/56662 | 12/1998 |
| WO | WO 99/15599 | 4/1999 |
| WO | WO 99/29490 | 6/1999 |
| WO | WO 99/52788 | 10/1999 |
| WO | WO 99/67768 | 12/1999 |
| WO | WO 00/04396 | 1/2000 |

(56) References Cited

FOREIGN PATENT DOCUMENTS

| | | |
|---|---|---|
| WO | WO 00/29469 | 5/2000 |
| WO | WO 00/61371 | 10/2000 |
| WO | WO 01/19598 | 3/2001 |
| WO | WO 01/19692 | 3/2001 |
| WO | WO 01/38434 | 5/2001 |
| WO | WO 01/55276 | 8/2001 |
| WO | WO 01/64435 | 9/2001 |
| WO | WO 01/83612 | 11/2001 |
| WO | WO 01/87751 | 11/2001 |
| WO | WO 01/90227 | 11/2001 |
| WO | WO 00/27631 | 1/2002 |
| WO | WO 02/06133 | 1/2002 |
| WO | WO 02/38192 | 5/2002 |
| WO | WO 02/38193 | 5/2002 |
| WO | WO 02/38194 | 5/2002 |
| WO | WO 02/38641 | 5/2002 |
| WO | WO 02/066569 | 8/2002 |
| WO | WO 02/072441 | 9/2002 |
| WO | WO 03/006229 | 1/2003 |
| WO | WO 03/016026 | 2/2003 |
| WO | WO 03/016053 | 2/2003 |
| WO | WO 03/039775 | 2/2003 |
| WO | WO 03/029002 | 4/2003 |
| WO | WO 03/033262 | 4/2003 |
| WO | WO 03/055937 | 7/2003 |
| WO | WO 03/061957 | 7/2003 |
| WO | WO 03/073401 | 9/2003 |
| WO | WO 03/078152 | 9/2003 |
| WO | WO 2004/012938 | 2/2004 |
| WO | WO 2004/013831 | 2/2004 |
| WO | WO 2004/014635 | 2/2004 |
| WO | WO 2004/018198 | 3/2004 |
| WO | WO 2004/018204 | 3/2004 |
| WO | WO 2004/022646 | 3/2004 |
| WO | WO 2004/033541 | 4/2004 |
| WO | WO 2004/071962 | 4/2004 |
| WO | WO 2004/052644 | 6/2004 |
| WO | WO 2004/094139 | 11/2004 |
| WO | WO 2004/110750 | 12/2004 |
| WO | WO 2004/112684 | 12/2004 |
| WO | WO 2005/045385 | 5/2005 |
| WO | WO 2005/048218 | 5/2005 |
| WO | WO 2005/056292 | 6/2005 |
| WO | WO 2005/061595 | 7/2005 |
| WO | WO 2005/061596 | 7/2005 |
| WO | WO 2005/061628 | 7/2005 |
| WO | WO 2005/063485 | 7/2005 |
| WO | WO 2005/068521 | 7/2005 |
| WO | WO 2005/073468 | 8/2005 |
| WO | WO 2005/075296 | 8/2005 |
| WO | WO 2005/086122 | 8/2005 |
| WO | WO 2005/083000 | 9/2005 |
| WO | WO 2005/085381 | 9/2005 |
| WO | WO 2005/092721 | 10/2005 |
| WO | WO 2005/095106 | 10/2005 |
| WO | WO 2005/095381 | 10/2005 |
| WO | WO 2005/100498 | 10/2005 |
| WO | WO 2005/110746 | 11/2005 |
| WO | WO 2005/113699 | 12/2005 |
| WO | WO 2005/118288 | 12/2005 |
| WO | WO 2005/123525 | 12/2005 |
| WO | WO 2006/004094 | 2/2006 |
| WO | WO 2006/013967 | 2/2006 |
| WO | WO 2006/015884 | 2/2006 |
| WO | WO 2006/047655 | 5/2006 |
| WO | WO 2006/047665 | 5/2006 |
| WO | WO 2006/051628 | 5/2006 |
| WO | WO 2006/051884 | 5/2006 |
| WO | WO 2006/051920 | 5/2006 |
| WO | WO 2006/060766 | 6/2006 |
| WO | WO 2006/062742 | 6/2006 |
| WO | WO 2006/070933 | 7/2006 |
| WO | WO 2006/075634 | 7/2006 |
| WO | WO 2006/077845 | 7/2006 |
| WO | WO 2006/084214 | 8/2006 |
| WO | WO 2006/095730 | 9/2006 |
| WO | WO 2006/109662 | 10/2006 |
| WO | WO 2006/113488 | 10/2006 |
| WO | WO 2006/121118 | 11/2006 |
| WO | WO 2006/134647 | 12/2006 |
| WO | WO 2007/015244 | 2/2007 |
| WO | WO 2007/054661 | 5/2007 |
| WO | WO 2007/069615 | 6/2007 |
| WO | WO 2008/044221 | 4/2008 |
| WO | WO 2009/124228 | 1/2009 |

OTHER PUBLICATIONS

Patent Examination Report No. 1 issued in corresponding Australian Application No. 2012-202782 dated Jan. 21, 2012.

Notification of First Office Action issued in corresponding Chinese Application No. 200880018553.2 dated Jun. 25, 2012.

First Office Action issued in corresponding Columbian Application No. 09 108 718 dated Oct. 9, 2012.

Notice of Preliminary Rejection issued in corresponding Korean Application No. 10-2009-7023046 dated May 30, 2011.

International Preliminary Report on Patentability issued in corresponding International Application No. PCT/US2008/059397 dated Jun. 2, 2009.

International Search Report and Written Opinion of the ISA issued in corresponding International Application No. PCT/US2008/059397 dated Aug. 18, 2008.

Reply to ISA Written Opinion submitted in corresponding International Application No. PCT/US2008/059397 dated Oct. 16, 2008.

Reply to the Written Opinion of the IPEA submitted in corresponding International Application No. PCT/US2008/059397 dated May 8, 2009.

Written Opinion of the IPEA issued in corresponding International Application No. PCT/US2008/059397 dated Mar. 9, 2009.

First Office Action issued in corresponding Russian Application No. 2009/140660 dated Oct. 8, 2012.

Advisory Action issued in U.S. Appl. No. 12/532,845 dated Nov. 8, 2012.

Amendment submitted in U.S. Appl. No. 12/532,845 dated Mar. 29, 2011.

Amendment submitted in U.S. Appl. No. 12/532,845 dated Oct. 10, 2012.

Notice of Allowance issued in U.S. Appl. No. 12/532,845 dated Dec. 11, 2012.

Office Action issued in U.S. Appl. No. 12/532,845 dated Dec. 30, 2011.

Office Action issued in U.S. Appl. No. 12/532,845 dated Jun. 13, 2012.

Response to Restriction Requirement submitted in U.S. Appl. No. 12/532,845 dated Oct. 18, 2011.

Restriction Requirement issued in U.S. Appl. No. 12/532,845 dated Aug. 11, 2011.

Amendment submitted in U.S. Appl. No. 12/237,737 dated Mar. 11, 2011.

Amendment submitted in U.S. Appl. No. 12/237,737 dated May 17, 2012.

Amendment submitted in U.S. Appl. No. 12/237,737 dated Oct. 3, 2011.

Notice of Allowance issued in U.S. Appl. No. 12/237,737 dated Jun. 8, 2012, and Corrected Notice of Allowability dated Aug. 7, 2012.

Office Action issued in U.S. Appl. No. 12/237,737 dated Dec. 19, 2011.

Office Action issued in U.S. Appl. No. 12/237,737 dated May 3, 2011.

Office Action issued in U.S. Appl. No. 12/237,737 dated Sep. 15, 2010.

Response to Restriction Requirement submitted in U.S. Appl. No. 12/237,737 dated Jul. 28, 2010.

Restriction Requirement issued in U.S. Appl. No. 12/237,737 dated May 17, 2010.

Advisory Action issued in U.S. Appl. No. 12/237,761 dated Apr. 12, 2011.

Amendment submitted in U.S. Appl. No. 12/237,761 dated Jun. 16, 2011.

(56) References Cited

OTHER PUBLICATIONS

Amendment submitted in U.S. Appl. No. 12/237,761 dated Dec. 6, 2011.
Amendment submitted in U.S. Appl. No. 12/237,761 dated Jun. 18, 2012.
Amendment submitted in U.S. Appl. No. 12/237,761 dated Mar. 22, 2011.
Amendment submitted in U.S. Appl. No. 12/237,761 dated Oct. 15, 2012.
Amendment submitted in U.S. Appl. No. 12/237,761 dated Oct. 20, 2010.
Office Action issued in U.S. Appl. No. 12/237,761 dated Apr. 20, 2010.
Office Action issued in U.S. Appl. No. 12/237,761 dated Dec. 16, 2011.
Office Action issued in U.S. Appl. No. 12/237,761 dated Jul. 8, 2011.
Office Action issued in U.S. Appl. No. 12/237,761 dated Jun. 28, 2012.
Office Action issued in U.S. Appl. No. 12/237,761 dated Nov. 23, 2012.
Amendment submitted in U.S. Appl. No. 12/845,037 dated Jan. 7, 2013.
Amendment submitted in U.S. Appl. No. 12/845,037 dated Jun. 19, 2012.
Amendment submitted in U.S. Appl. No. 12/845,037 dated May 6, 2011.
Amendment submitted in U.S. Appl. No. 12/845,037 dated Nov. 28, 2011.
Office Action issued in U.S. Appl. No. 12/845,037 dated Dec. 19, 2011.
Office Action issued in U.S. Appl. No. 12/845,037 dated Feb. 18, 2011.
Office Action issued in U.S. Appl. No. 12/845,037 dated Jul. 6, 2012.
Office Action issued in U.S. Appl. No. 12/845,037 dated Jun. 17, 2011.
Office Action issued in U.S. Appl. No. 13/628,076 dated Dec. 26, 2012.
Response to International Preliminary Report on Patentability submitted in European Application No. 10 740 088.9 dated Sep. 18, 2012.
International Preliminary Report on Patentability issued in corresponding International Application No. PCT/US2010/043343 dated Jan. 31, 2012.
International Search Report and Written Opinion issued in corresponding International Application No. PCT/US2010/043343 dated Feb. 9, 2011.
Invitation to Pay Additional Fees issued in corresponding International Application No. PCT/US2010/043343 dated Nov. 9, 2010.
Response to Invitation to Pay Additional Fees submitted in corresponding International Application No. PCT/US2010/043343 dated Dec. 7, 2010.
Written Opinion issued in corresponding International Application No. PCT/US2010/043343 dated Jan. 27, 2012.
Notification of First Office Action issued in corresponding Chinese Application No. 200980120882.2 dated Sep. 22, 2011.
Notification of Second Office Action issued in corresponding Chinese Application No. 200980120882.2 dated Jun. 6, 2012.
Notification of the Decision of Rejection issued in corresponding Chinese Application No. 200980120882.2 dated Jan. 16, 2013.
First Office Action issued in corresponding Columbian Application No. 10 122 737 dated Oct. 30, 2012.
European Search Report issued in corresponding European Application No. 11 002 942 dated May 27, 2011.
International Preliminary Report on Patentability issued in corresponding International Application No. PCT/US2009/039392 dated Jul. 16, 2010.
International Search Report and Written Opinion issued in corresponding International Application No. PCT/US2009/039392 dated Jul. 2, 2009.
First Office Action issued in corresponding Canadian Application No. 2,720,568 dated Mar. 23, 2012.
First Office Action issued in corresponding Chinese Application No. 200980120884.1 dated Sep. 23, 2011.
Second Office Action issued in corresponding Chinese Application No. 200980120884.1 dated May 31, 2012.
First Office Action issued in corresponding Columbian Application No. 10 122 742 dated Oct. 20, 2012.
First Office Action issued in corresponding European Application No. 09 727 646.3-1261 dated Jan. 26, 2012.
Response to IPRP submitted in corresponding European Application No. 09 727 646.3-1261 dated Dec. 20, 2010.
International Preliminary Report on Patentability issued in corresponding International Application No. PCT/US2009/039398 dated Oct. 14, 2010.
International Search Report and Written Opinion issued in corresponding International Application No. PCT/US2009/039398 dated Jul. 2, 2009.
International Search Report issued in corresponding International Application No. PCT/US2011/021968 dated Nov. 17, 2011.
Invitation to Pay Additional Fees issued in corresponding International Application No. PCT/US2011/021968 dated Jun. 14, 2011.
First Office Action issued in corresponding Columbian Application No. 11-36744 dated Nov. 27, 2012.
International Search Report and Written Opinion issued in corresponding International Application No. PCT/US2010/061272 dated May 27, 2011.
Office Action issued in U.S. Appl. No. 12/973,211 dated Oct. 26, 2012.
ASTM D 1204-94, Standard Test Method for Linear Dimensional Changes of Nongrid Thermoplastic Sheeting or Film at Elevated Temperature, pp. 256-257.
Definition of term "compound curve" from Merriam-Webster Dictionary.
Istvan Benedek and Luc J. Heymans, "Pressure Sensitive Adhesives Technology", 1997, Marcel Dekker, Inc., pp. 262-263 and 435-442.
Jiri George Drobny, "Heat Shrinkable Films and Tubing" from Handbook of Thermoplastic Elastomers, 2007, William Andrew Publishing, pp. 132-133.
First Office Action issued in corresponding Canadian Application No. 2,671,723 dated May 3, 2013.
Notification of Second Office Action issued in corresponding Chinese Application No. 200880018553.2 dated Apr. 11, 2013.
Notification of Third Office Action issued in corresponding Chinese Application No. 200880018553.2 dated Oct. 25, 2013.
Notification of Decision of Final Rejection issued in corresponding Chinese Application No. 200880018553.2 dated Jul. 29, 2014.
First Office Action issued in corresponding Columbian Application No. 09 108 718A dated Apr. 8, 2014.
First Office Action issued in corresponding Columbian Application No. 09 108 718B dated Apr. 8, 2014.
Office Action issued in corresponding EP Application No. 08 745 103.5 dated Sep. 27, 2013.
First Examination Report issued in corresponding IN Application No. 6153/DELNP/2009 dated Jan. 16, 2015.
Office Action issued in corresponding JP Application No. 2010-502320 dated Apr. 2013.
Substantive Examination Report issued in corresponding Malasian Application No. PI20094136 dated Feb. 15, 2013.
Second Office Action issued in corresponding Russian Application No. 2009/140660 dated Feb. 2, 2013.
First Office Action issued in corresponding Russian Application No. 2012146605 dated Feb. 2014.
Second Office Action issued in corresponding Russian Application No. 2012146605 dated Oct. 2014.
Notice of Allowance issued in U.S. Appl. No. 12/237,761 dated Jun. 7, 2013.
Amendment submitted in U.S. Appl. No. 12/237,761 dated May 23, 2013.
Amendment submitted in U.S. Appl. No. 13/628,076 dated Nov. 24, 2014.
Office Action issued in U.S. Appl. No. 13/628,076 dated May 15, 2014.

(56) References Cited

OTHER PUBLICATIONS

Amendment submitted in U.S. Appl. No. 13/628,076 dated Apr. 10, 2014.
Office Action issued in U.S. Appl. No. 13/628,076 dated Oct. 10, 2013.
Amendment submitted in U.S. Appl. No. 13/628,076 dated Jun. 26, 2013.
Examination Report No. 1 issued in corresponding Australian Application No. 2010281481 dated Mar. 21, 2014.
First Office Action issued in corresponding Chinese Application No. 201080042689.4 dated Oct. 22, 2013.
Second Office Action issued in corresponding Chinese Application No. 201080042689.4 dated Dec. 26, 2014.
First Office Action issued in corresponding Chinese Application No. 201310397352.0 dated Oct. 17, 2014.
Second Office Action issued in corresponding Chinese Application No. 201310397352.0 dated Apr. 15, 2015.
First Office Action issued in corresponding Chinese Application No. 201310397478.8 dated Oct. 28, 2014.
Office Action issued in corresponding Columbian Application No. 12-012438 dated Oct. 20, 2013.
Office Action issued in corresponding EP Application No. 10 740 088.9 dated Apr. 26, 2013.
Extended EP Search Report issued in corresponding Application No. 13 001 452.5 dated Apr. 26, 2013.
Extended EP Search Report issued in corresponding Application No. 13 001 451.7 dated May 8, 2013.
Office Action issued in corresponding Japanese Application No. 2012-522955 dated Sep. 30, 2014.
Restriction Requirement issued in corresponding U.S. Appl. No. 13/384,649 dated Mar. 20, 2013.
Response to Restriction Requirement submitted in corresponding U.S. Appl. No. 13/384,649 dated Apr. 16, 2013.
Office Action issued in corresponding U.S. Appl. No. 13/384,649 dated May 23, 2013.
Amendment submitted in corresponding U.S. Appl. No. 13/384,649 dated Nov. 21, 2013.
Office Action issued in corresponding U.S. Appl. No. 13/384,649 dated Jun. 9, 2015.
Examination Report issued in corresponding Australian Application No. 2009231681 dated Apr. 9, 2013.
Office Action issued in corresponding Canadian Application No. 2,720,590 dated Mar. 12, 2015.
Notification of Third Office Action issued in corresponding Chinese Application No. 200980120882.2 dated Sep. 26, 2013.
Office Action issued in corresponding Japanese Application No. 2011-503195 dated Apr. 31, 2013.
Substantive Examination Report issued in corresponding Malaysian Application No. PI2010004659 dated May 25, 2014.
First Office Action issued in corresponding Australian Application No. 2009231682 dated Sep. 4, 2013.
Second Office Action issued in corresponding Canadian Application No. 2,720,568 dated Jan. 24, 2013.
Third Office Action issued in corresponding Chinese Application No. 200980120884.1 dated Feb. 5, 2013.
Second Office Action issued in corresponding Japanese Application No. 2011/503196 dated Apr. 30, 2014.
First Office Action issued in corresponding Japanese Application No. 2011/503196 dated May 10, 2013.
Substantive Examination Report issued in corresponding Malaysian Application No. PI2010004660 dated Apr. 30, 2014.
Office Action issued in corresponding Russian Application No. 2010145233 dated Jun. 26, 2013.
Examination Report issued in corresponding Australian Application No. 2011209848 dated Mar. 28, 2014.
First Office Action issued in corresponding Chinese Application No. 201180016909.0 dated Dec. 19, 2013.
Second Office Action issued in corresponding Chinese Application No. 201180016909.0 dated Sep. 30, 2014.
Office Action issued in corresponding Columbian Application No. 12-126532 dated Oct. 31, 2013.
Office Action issued in corresponding European Application No. 11 702 340.8 dated May 17, 2013.
Extended EP Search Report issued in corresponding European Application No. 14 001 198.2 dated Jun. 12, 2014.
Extended EP Search Report issued in corresponding European Application No. 14 001 197.4 dated Jun. 12, 2014.
Extended EP Search Report issued in corresponding European Application No. 14 001 196.6 dated Jun. 12, 2014.
Office Action issued in corresponding Japanese Application No. 2012-551201 dated Jan. 23, 2015.
Office Action issued in corresponding Russian Application No. 2012-551201 dated Dec. 24, 2014.
Examination Report No. 1 issued in corresponding AU Application No. 2010291892 dated Mar. 14, 2014.
Examination Report No. 2 issued in corresponding AU Application No. 2010291892 dated May 22, 2015.
Second Office Action issued in corresponding Chinese Application No. 201080003311.3 dated Jan. 16, 2015.
First Office Action issued in corresponding Chinese Application No. 201080003311.3 dated Jan. 2, 2014.
First Office Action issued in corresponding Japanese Application No. 2012/551159 dated Sep. 5, 2014.
Second Office Action issued in corresponding Japanese Application No. 2012/551159 dated May 29, 2015.
Amendment submitted in corresponding U.S. Appl. No. 12/973,211 dated Mar. 2, 2015.
Amendment submitted in corresponding U.S. Appl. No. 12/973,211 dated Apr. 26, 2013.
Amendment submitted in corresponding U.S. Appl. No. 12/973,211 dated Nov. 13, 2013.
Office Action issued in corresponding U.S. Appl. No. 12/973,211 dated Aug. 29, 2014.
Office Action issued in corresponding U.S. Appl. No. 12/973,211 dated Jun. 19, 2015.
Office Action issued in corresponding U.S. Appl. No. 12/973,211 dated Jul. 18, 2013.
International Search Report and Written Opinion issued in corresponding International Application No. PCT/US2013/069035 dated Feb. 18, 2014.
International Preliminary Report on Patentability issued in corresponding International Application No. PCT/US2013/069035 dated May 12, 2015.
Written Opinion issued in corresponding International Application No. PCT/US2013/055244 dated Apr. 4, 2014.
International Search Report issued in corresponding International Application No. PCT/US2013/055244 dated Apr. 4, 2014.
International Preliminary Report on Patentability issued in corresponding International Application No. PCT/US2013/055244 dated Feb. 17, 2015.
Brochure of CorTuff™ High-Abuse Shrink Film from Sealed Air, retrieved on Sep. 30, 2013.

* cited by examiner

LABEL APPLICATOR BELT SYSTEM

CROSS REFERENCES TO RELATED APPLICATIONS

The present application is a 371 of International Application No. PCT/US2011/021968, which was published in English on Aug. 4, 2011, which claims priority to U.S. Provisional Application No. 61/299,151 filed Jan. 28, 2010 which is incorporated herein by reference in it.

FIELD OF THE INVENTION

The present invention relates to equipment and methods for applying labels such as shrink labels to a curved surface, and particularly to a compound curved surface.

BACKGROUND OF THE INVENTION

It is known to apply labels to containers or bottles to provide information such as the supplier or the contents of the container. Such containers and bottles are available in a wide variety of shapes and sizes for holding many different types of materials such as detergents, chemicals, personal care products, motor oil, beverages, etc.

Polymeric film materials and film facestocks have been used as labels in various fields. Polymeric labels are increasingly desired for many applications, particularly transparent polymeric labels since they provide a no-label look to decorated glass and plastic containers. Paper labels block the visibility of the container and/or the contents in the container. Clear polymeric labels enhance the visual aesthetics of the container, and therefore the product. The popularity of polymeric labels is increasing much faster than that of paper labels in the package decoration market as consumer product companies are continuously trying to upgrade the appearance of their products. Polymeric film labels also have superior mechanical properties as compared to paper labels, such as greater tensile strength and abrasion resistance.

Traditional polymeric pressure sensitive (PSA) labels often exhibit difficulty adhering smoothly to containers having curved surfaces and/or complex shapes without wrinkling, darting or lifting on the curved surfaces. As a result, heat shrink sleeve labels have typically been used on these types of containers having compound curved surfaces. Direct screen printing is another method for applying indicia or other markings to curved surfaces. Labeling operations for heat shrink sleeve type labels are carried out using processes and methods that form a tube or sleeve of the heat shrink film that is placed over the container and heated in order to shrink the film to conform to the size and shape of the container. Alternatively, the containers are completely wrapped with a shrink label using a process in which the shrink film is applied to the container directly from a continuous roll of film material and then heat is applied to conform the wrapped label to the container. Regardless, label defects frequently occur during labeling operations of simple or compound shaped bottles during label application or in post label application processes. These misapplied labels result in high scrap or extra processing steps that can be costly.

Other processes for applying pressure sensitive shrink labels are known. In certain applications, a label is applied onto a container, heated, and any resulting defects then wiped to minimize such defects. A potential problem exists with a separate heat and wipe process with pressure sensitive shrink labels where edge defects are initially formed and then removed. Although the formation of the edge defects typically occurs in the same general region of the bottle, the defects are not in the exact same spot, nor of the same size or occur in the same number. These defects, collectively referred to herein as "darts" can in certain instances, be shrunk with heat. As these defects shrink, the area of the label comprising the dart is reduced along with the ink and print on top of the label dart. The shrinkage of the dart will shrink the print as well cause distortion of the print. Depending on the size of the dart and print fidelity, the distortion might be noticed and can in certain cases, be significant. This distortion may limit the type or quality of print in the shrink region of the label. Therefore, avoiding the formation of darts entirely would be of great benefit.

Accordingly, a need exists for a process and related system in which a shrink label could be applied to a curved surface and particularly a compound curved surface without the occurrence of darts or other defects.

SUMMARY OF THE INVENTION

The difficulties and drawbacks associated with previously known processes and label application systems are overcome in the present processes and systems, all of which are described in greater detail herein.

In one aspect, the present invention provides a system for applying labels onto articles. The system comprises a first assembly of a first belt and a first plurality of rollers, the first belt extending around the first plurality of rollers. The system also comprises a second assembly of a second belt and a second plurality of rollers, the second belt extending around the second plurality of rollers. The first assembly and the second assembly are arranged relative to one another such that a portion of the first belt and a portion of the second belt are aligned with one another to define an article receiving lane between the portion of the first belt and the portion of the second belt. In this aspect of the invention, the lane extends in at least two different directions.

In another aspect, the present invention provides a system for applying labels onto articles. The system comprises a first assembly of a first belt and a first plurality of rollers, the first belt extending around the first plurality of rollers. The system also comprises a second assembly of a second belt and a second plurality of rollers, the second belt extending around the second plurality of rollers. The first assembly and the second assembly are arranged relative to one another such that a portion of the first belt and a portion of the second belt are aligned and parallel with one another to define an article receiving lane between the portion of the first belt and the portion of the second belt. In this aspect of the invention, the velocity of the first belt is different than the velocity of the second belt.

In still another aspect, the present invention provides a system for applying labels onto articles. The system comprises a first assembly of a first belt and a first plurality of rollers, the first belt extending around the first plurality of rollers. The system also comprises a second assembly of a second belt and a second plurality of rollers, the second belt extending around the second plurality of rollers. The first assembly and the second assembly are arranged relative to one another such that a portion of the first belt and a portion of the second belt are aligned with one another to define an article receiving lane between the portion of the first belt and the portion of the second belt. In this aspect of the present invention, the lane extends in a relatively straight direction.

In still another aspect, the present invention provides a system for applying labels onto articles. The system comprises a first assembly of a first belt and a first plurality of rollers, the first belt extending around the first plurality of rollers. The system also comprises a second assembly of a second belt and a second plurality of rollers, the second belt extending around the second plurality of rollers. The first assembly and the second assembly are arranged relative to one another such that a portion of the first belt and a portion of the second belt are aligned with one another to define an article receiving lane between the portion of the first belt and the portion of the second belt. In this aspect of the invention, the lane extends in an arcuate fashion.

In yet still another aspect, the present invention provides a method of applying labels onto articles using a system including a first assembly of a first belt extending about a first collection of rollers, and a second assembly of a second belt extending about a second collection of rollers. The first and second assemblies are arranged such that a portion of the first belt and a portion of the second belt are aligned with one another to define an article receiving lane having a region extending in at least two different directions. The method comprises initially adhering a label onto an outer surface of an article to receive the label. The method also comprises moving the first belt about the first collection of rollers and moving the second belt about the second collection of rollers such that the first and second belts are generally displaced alongside one another within the lane. And, the method comprises introducing the article and label initially adhered thereto at a first location in the lane such that the first and second belts contact and transport the article and label to a second location in the lane. The second location is located downstream of the first location and the region of the lane that extends in at least two different directions. As the article is transported from the first location to the second location, the label is fully contacted with and applied onto the article.

In another aspect, the present invention also provides a method of applying labels onto articles using a system including a first assembly of a first belt extending about a first collection of rollers and a second assembly of a second belt extending about a second collection of rollers. The first and second assemblies are arranged such that a portion of the first belt and a portion of the second belt are aligned and parallel with one another to define an article receiving lane. The method comprises initially adhering a label onto an outer surface of an article to receive the label. The method also comprises moving the first belt about the first collection of rollers at a first velocity and moving the second belt about the second collection of rollers at a second velocity different than the first velocity. And, the method further comprises introducing the article and label initially adhered thereto at a first location in the lane such that the first and second belts contact and transport the article and label to a second location in the lane. The second location is located downstream of the first location. As the article is transported from the first location to the second location, the label is fully contacted with and applied onto the article.

In still another aspect, the present invention provides a method of applying labels onto articles using a system including a first assembly of a first belt extending about a first collection of rollers and a second assembly of a second belt extending about a second collection of rollers. The first and second assemblies are arranged such that a portion of the first belt and a portion of the second belt are aligned with one another to define an article receiving lane extending in an arcuate fashion. The method comprises initially adhering a label onto an outer surface of an article to receive the label. The method also comprises moving the first belt about the first collection of rollers and moving the second belt about the second collection of rollers such that the first and second belts are generally displaced alongside one another within the lane. And, the method further comprises introducing the article and label initially adhered thereto at a first location in the lane such that the first and second belts contact and transport the article and label to a second location in the lane. The second location is located downstream of the first location. As the article is transported from the first location to the second location, the label is fully contacted with and applied onto the article.

And in yet another aspect, the present invention also provides a method of applying labels onto articles using a system including a first assembly of a first belt extending about a first collection of rollers and a second assembly of a second belt extending about a second collection of rollers. The first and second assemblies are arranged such that a portion of the first belt and a portion of the second belt are aligned with one another to define an article receiving lane extending in a relatively straight direction. The method comprises initially adhering a label onto an outer surface of an article to receive the label. The method also comprises moving the first belt about the first collection of rollers and moving the second belt about the second collection of rollers such that the first and second belts are generally displaced alongside one another within the lane. And, the method comprises introducing the article and label initially adhered thereto at a first location in the lane such that the first and second belts contact and transport the article and label to a second location in the lane. The second location is located downstream of the first location. As the article is transported from the first location to the second location, the label is fully contacted with and applied onto the article.

In another aspect, the invention provides a label application system comprising a label assembly including a polymeric film and a layer of adhesive on the film; and equipment for applying labels onto articles. The equipment comprises (i) a first assembly of a first belt and a first plurality of rollers, the first belt extending around the first plurality of rollers, and (ii) a second assembly of a second belt and a second plurality of rollers, the second belt extending around the second plurality of rollers. The first assembly and the second assembly are arranged relative to one another such that a portion of the first belt and a portion of the second belt are aligned with one another to define an article receiving lane between the portion of the first belt and the portion of the second belt. The lane extends in at least two different directions.

In still another aspect, the present invention provides a label application system comprising a label assembly including a polymeric film and a layer of adhesive on the film; and equipment for applying labels onto articles. The equipment comprises (i) a first assembly of a first belt and a first plurality of rollers, the first belt extending around the first plurality of rollers, and (ii) a second assembly of a second belt and a second plurality of rollers, the second belt extending around the second plurality of rollers. The first assembly and the second assembly are arranged relative to one another such that a portion of the first belt and a portion of the second belt are aligned with one another to define an article receiving lane between the portion of the first belt and the portion of the second belt. The lane extends in a relatively straight direction.

In yet another aspect, the present invention provides a label application system comprising a label assembly including a polymeric film and a layer of adhesive on the film; and equipment for applying labels onto articles. The equipment comprises (i) a first assembly of a first belt and a first plurality of rollers, the first belt extending around the first plurality of rollers, and (ii) a second assembly of a second belt and a second plurality of rollers, the second belt extending around the second plurality of rollers. The first assembly and the second assembly are arranged relative to one another such that a portion of the first belt and a portion of the second belt are aligned with one another to define an article receiving lane between the portion of the first belt and the portion of the second belt. The lane extends in an arcuate fashion.

As will be realized, the invention is capable of other and different embodiments and its several details are capable of modifications in various respects, all without departing from the invention. Accordingly, the drawings and description are to be regarded as illustrative and not restrictive.

DETAILED DESCRIPTION OF THE EMBODIMENTS

Figure 1:
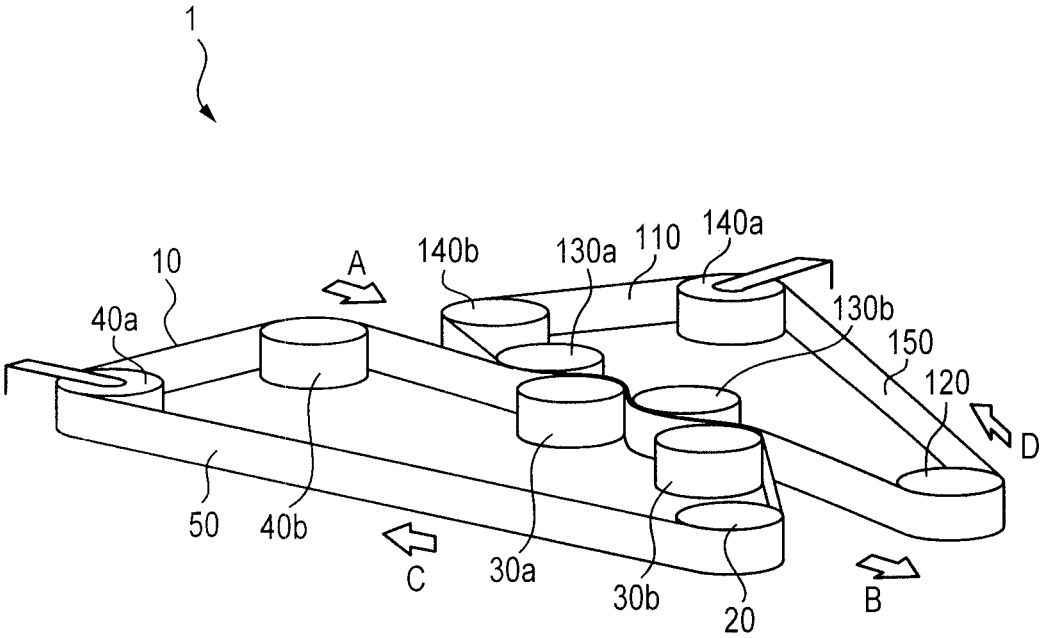
FIG. 1 is a perspective view of a preferred embodiment system in accordance with the present invention.

The present invention provides further advances in strategies, methods, components, and equipment for applying labels and films onto curved surfaces such as outer curved surfaces of various containers. Although the present invention is described in terms of applying labels or films to containers, it will be understood that the invention is not limited to containers. Instead, the invention can be used to apply a variety of labels or films onto surfaces of nearly any type of article. The invention is particularly directed to applying shrink labels onto curved container surfaces. And, the invention is also particularly directed to applying labels such as heat shrink labels onto compound curved surfaces of various containers. References are made herein to containers having curved surfaces or compound curved surfaces. A curved surface is a surface defined by a line moving along a curved path. A compound curved surface is a particular type of curved surface in which the previously noted line is a curved line. Examples of a compound curved surface include, but are not limited to, the outer surface of a sphere, a hyperbolic parabloid, and a dome.

It is to be understood that the present invention can be used for applying labels and films onto a wide variety of surfaces, including planar surfaces and simple curved surfaces. However, as explained in greater detail herein, the invention is particularly well suited for applying labels and films onto compound curved surfaces most particularly, upon outwardly extending compound curved surfaces.

Labels/Film

The polymeric films useful in the label constructions, the application of which the present invention is directed, preferably possess balanced shrink properties. The balanced shrink properties allow the film to shrink in multiple directions to thereby follow the contour of a compound curved surface as the label is applied upon the curved surfaces. Films having unbalanced shrink, that is, films having a high degree of shrink in one direction and low to moderate shrink in the other direction, can be used. Useful films having balanced shrink allow for a wider variety of label shapes to be applied to a wider variety of container shapes. Generally, films having balanced shrink properties are preferred.

In one embodiment, the polymeric film has an ultimate shrinkage (S) as measured by ASTM procedure D1204 in at least one direction of at least 10% at 90° C. and in the other direction, the shrinkage is within the range of S+/−20%. In another embodiment, the film has an ultimate shrinkage (S) in at least one direction of about 10% to about 50% at 70° C. and in the other direction, the shrinkage is within the range of S+/−20%. In one embodiment, the ultimate shrinkage (S) is at least 10% at 90° C. and in the other direction, the shrinkage is within the range of S+/−20%. The shrink initiation temperature of the film, in one embodiment, is in the range of about 60° C. to about 80° C.

The shrink film must be thermally shrinkable and yet have sufficient stiffness to be dispensed using conventional labeling equipment and processes, including printing, die-cutting and label transfer. The stiffness of the film required depends on the size of the label, the speed of application and the labeling equipment being used. In one embodiment, the shrink film has a stiffness in the machine direction (MD) of at least 5 mN, as measured by the L&W Bending Resistance test. In one embodiment, the shrink film has a stiffness of at least 10 mN, or at least 20 mN. The stiffness of the shrink film is important for proper dispensing of labels over a peel plate at higher line speeds.

In one embodiment, die-cut labels are applied to the article or container in an automated labeling line process at a line speed of at least 30 units per minute, and preferably from at least 250 units per minute to at least 500 units per minute. It is contemplated that the present invention could be used in conjunction with processes operating as fast as 700 to 800 units per minutes, or more.

In one embodiment, the shrink film has a 2% secant modulus as measured by ASTM D882 in the machine direction (MD) of about 138,000,000 $N/m^2$ to about 2,760,000,000 $N/m^2$, and in the transverse (or cross) direction (TD) of about 138,000,000 $N/m^2$ to about 2,760,000,000 $N/m^2$. In another embodiment, the 2% secant modulus of the film is about 206,000,000 $N/m^2$ to about 2,060,000,000 $N/m^2$ in the machine direction and about 206,000,000 $N/m^2$ to about 2,060,000,000 $N/m^2$ in the transverse direction. The film may have a lower modulus in the transverse direction than in the machine direction so that the label is easily dispensed (MD) while maintaining sufficiently low modulus in the TD for conformability and/or squeezability.

The polymeric film may be made by conventional processes. For example, the film may be produced using a double bubble process, tenter process or may comprise a blown film.

The shrink film useful in the label may be a single layer construction or a multilayer construction. The layer or layers of the shrink film may be formed from a polymer chosen from polyester, polyolefin, polyvinyl chloride, polystyrene, polylactic acid, copolymers and blends thereof.

Polyolefins comprise homopolymers or copolymers of olefins that are aliphatic hydrocarbons having one or more carbon to carbon double bonds. Olefins include alkenes that comprise 1-alkenes, also known as alpha-olefins, such as 1-butene and internal alkenes having the carbon to carbon double bond on nonterminal carbon atoms of the carbon chain, such as 2-butene, cyclic olefins having one or more carbon to carbon double bonds, such as cyclohexene and norbornadiene, and cyclic polyenes which are noncyclic aliphatic hydrocarbons having two or more carbon to carbon double bonds, such as 1,4-butadiene and isoprene. Polyolefins comprise alkene homopolymers from a single alkene monomer, such as a polypropylene homopolymer, alkene copolymers from at least one alkene monomer and one or more additional olefin monomers where the first listed alkene is the major constituent of the copolymer, such as a propylene-ethylene copolymer and a propylene-ethylene-butadiene copolymer, cyclic olefin homopolymers from a single cyclic olefin monomer, and cyclic olefin copolymers from at least one cyclic olefin monomer and one or more additional olefin monomers wherein the first listed cyclic olefin is the major constituent of the copolymer, and mixtures of any of the foregoing olefin polymers.

In one embodiment, the shrink film is a multilayer film comprising a core layer and at least one skin layer. The skin layer may be a printable skin layer. In one embodiment, the multilayer shrink film comprises a core and two skin layers, wherein in at least one skin layer is printable. The multilayer shrink film may be a coextruded film.

The film can range in thickness from 12 to 500, or 12 to 300, or 12 to 200, or 25 to 75 microns. The difference in the layers of the film can include a difference in thermoplastic polymer components, in additive components, in orientation, in thickness, or a combination thereof. The thickness of the core layer can be 50 to 95%, or 60 to 95% or 70 to 90% of the thickness of the film. The thickness of a skin layer or of a combination of two skin layers can be 5 to 50%, or 5 to 40% or 10 to 30% of the thickness of the film.

The film can be further treated on one surface or both the upper and lower surfaces to enhance performance in terms of printability or adhesion to an adhesive. The treatment can comprise applying a surface coating such as, for example, a lacquer, applying a high energy discharge to include a corona discharge to a surface, applying a flame treatment to a surface, or a combination of any of the foregoing treatments. In an embodiment of the invention, the film is treated on both surfaces, and in another embodiment the film is treated on one surface with a corona discharge and is flame treated on the other surface.

The layers of the shrink film may contain pigments, fillers, stabilizers, light protective agents or other suitable modifying agents if desired. The film may also contain anti-block, slip additives and anti-static agents. Useful anti-block agents include inorganic particles, such as clays, talc, calcium carbonate and glass. Slip additives useful in the present invention include polysiloxanes, waxes, fatty amides, fatty acids, metal soaps and particulate such as silica, synthetic amorphous silica and polytetrafluoroethylene powder. Anti-static agents useful in the present invention include alkali metal sulfonates, polyether-modified polydiorganosiloxanes, polyalkylphenylsiloxanes and tertiary amines.

In one embodiment, the shrink film is microperforated to allow trapped air to be released from the interface between the label and the article to which it is adhered. In another embodiment, the shrink film is permeable to allow fluid to escape from the adhesive or from the surface of the article to escape. In one embodiment, vent holes or slits are provided in the shrink film.

The present invention can be used for applying, processing, and otherwise in association with, a wide array of labels, film, and other members. For example, the invention can be used in conjunction with shrink labels, pressure sensitive labels, pressure sensitive shrink labels, heat seal labels, and nearly any type of label or film known in the packaging and labeling arts.

Adhesive and Additional Aspects of Labels

A description of useful pressure sensitive adhesives may be found in *Encyclopedia of Polymer Science and Engineering*, Vol. 13, Wiley-Interscience Publishers (New York, 1988). Additional description of useful PSAs may be found in *Polymer Science and Technology*, Vol. 1, Interscience Publishers (New York, 1964). Conventional PSAs, including acrylic-based PSAs, rubber-based PSAs and silicone-based PSAs are useful. The PSA may be a solvent based or may be a water based adhesive. Hot melt adhesives may also be used. In one embodiment, the PSA comprises an acrylic emulsion adhesive.

The adhesive and the side of the film to which the adhesive is applied have sufficient compatibility to enable good adhesive anchorage. In one embodiment, the adhesive is chosen so that the labels may be cleanly removed from PET containers up to 24 hours after application. The adhesive is also chosen so that the adhesive components do not migrate into the film.

In one embodiment, the adhesive may be formed from an acrylic based polymer. It is contemplated that any acrylic based polymer capable of forming an adhesive layer with sufficient tack to adhere to a substrate may function in the present invention. In certain embodiments, the acrylic polymers for the pressure sensitive adhesive layers include those formed from polymerization of at least one alkyl acrylate monomer containing from about 4 to about 12 carbon atoms in the alkyl group, and present in an amount from about 35 to 95% by weight of the polymer or copolymer, as disclosed in U.S. Pat. No. 5,264,532. Optionally, the acrylic based pressure sensitive adhesive might be formed from a single polymeric species.

The glass transition temperature of a PSA layer comprising acrylic polymers can be varied by adjusting the amount of polar, or "hard monomers", in the copolymer, as taught by U.S. Pat. No. 5,264,532. The greater the percentage by weight of hard monomers included in an acrylic copolymer, the higher the glass transition temperature of the polymer. Hard monomers contemplated useful for the present invention include vinyl esters, carboxylic acids, and methacrylates, in concentrations by weight ranging from about 0 to about 35% by weight of the polymer.

The PSA can be acrylic based such as those taught in U.S. Pat. No. 5,164,444 (acrylic emulsion), U.S. Pat. No. 5,623,011 (tackified acrylic emulsion) and U.S. Pat. No. 6,306,982. The adhesive can also be rubber-based such as those taught in U.S. Pat. No. 5,705,551 (rubber hot melt). The adhesive can also include a radiation curable mixture of monomers with initiators and other ingredients such as those taught in U.S. Pat. No. 5,232,958 (UV cured acrylic) and U.S. Pat. No. 5,232,958 (EB cured). The disclosures of these patents as they relate to acrylic adhesives are hereby incorporated by reference.

Commercially available PSAs are useful in the invention. Examples of these adhesives include the hot melt PSAs available from H.B. Fuller Company, St. Paul, Minn. as HM-1597, HL-2207-X, HL-2115-X, HL-2193-X. Other useful commercially available PSAs include those available from Century Adhesives Corporation, Columbus, Ohio. Another useful acrylic PSA comprises a blend of emulsion polymer particles with dispersion tackifier particles as generally described in Example 2 of U.S. Pat. No. 6,306,982. The polymer is made by emulsion polymerization of 2-ethylhexyl acrylate, vinyl acetate, dioctyl maleate, and acrylic and methacrylic comonomers as described in U.S. Pat. No. 5,164,444 resulting in the latex particle size of about 0.2 microns in weight average diameters and a gel content of about 60%.

A commercial example of a hot melt adhesive is H2187-01, sold by Ato Findley, Inc., of Wauwatusa, Wis. In addition, rubber based block copolymer PSAs described in U.S. Pat. No. 3,239,478 also can be utilized in the adhesive constructions of the present invention, and this patent is hereby incorporated by a reference for its disclosure of such hot melt adhesives that are described more fully below.

In another embodiment, the pressure sensitive adhesive comprises rubber based elastomer materials containing useful rubber based elastomer materials include linear, branched, grafted, or radial block copolymers represented by the diblock structure A-B, the triblock A-B-A, the radial or coupled structures $(A\text{-}B)_n$, and combinations of these where A represents a hard thermoplastic phase or block which is non-rubbery or glassy or crystalline at room temperature but fluid at higher temperatures, and B represents a soft block which is rubbery or elastomeric at service or room temperature. These thermoplastic elastomers may comprise from about 75% to about 95% by weight of rubbery segments and from about 5% to about 25% by weight of non-rubbery segments.

The non-rubbery segments or hard blocks comprise polymers of mono- and polycyclic aromatic hydrocarbons, and more particularly vinyl-substituted aromatic hydrocarbons that may be monocyclic or bicyclic in nature. Rubbery materials such as polyisoprene, polybutadiene, and styrene butadiene rubbers may be used to form the rubbery block or segment. Particularly useful rubbery segments include polydienes and saturated olefin rubbers of ethylene/butylene or ethylene/propylene copolymers. The latter rubbers may be obtained from the corresponding unsaturated polyalkylene moieties such as polybutadiene and polyisoprene by hydrogenation thereof.

The block copolymers of vinyl aromatic hydrocarbons and conjugated dienes that may be utilized include any of those that exhibit elastomeric properties. The block copolymers may be diblock, triblock, multiblock, starblock, polyblock or graftblock copolymers. Throughout this specification, the terms diblock, triblock, multiblock, polyblock, and graft or grafted-block with respect to the structural features of block copolymers are to be given their normal meaning as defined in the literature such as in the *Encyclopedia of Polymer Science and Engineering*, Vol. 2, (1985) John Wiley & Sons, Inc., New York, pp. 325-326, and by J. E. McGrath in *Block Copolymers, Science Technology*, Dale J. Meier, Ed., Harwood Academic Publishers, 1979, at pages 1-5.

Such block copolymers may contain various ratios of conjugated dienes to vinyl aromatic hydrocarbons including those containing up to about 40% by weight of vinyl aromatic hydrocarbon. Accordingly, multi-block copolymers may be utilized which are linear or radial symmetric or asymmetric and which have structures represented by the formulae A-B, A-B-A, A-B-A-B, B-A-B, $(AB)_{0,1,2\ldots}BA$, etc., wherein A is a polymer block of a vinyl aromatic hydrocarbon or a conjugated diene/vinyl aromatic hydrocarbon tapered copolymer block, and B is a rubbery polymer block of a conjugated diene.

The block copolymers may be prepared by any of the well-known block polymerization or copolymerization procedures including sequential addition of monomer, incremental addition of monomer, or coupling techniques as illustrated in, for example, U.S. Pat. Nos. 3,251,905; 3,390,207; 3,598,887; and 4,219,627. As well known, tapered copolymer blocks can be incorporated in the multi-block copolymers by copolymerizing a mixture of conjugated diene and vinyl aromatic hydrocarbon monomers utilizing the difference in their copolymerization reactivity rates. Various patents describe the preparation of multi-block copolymers containing tapered copolymer blocks including U.S. Pat. Nos. 3,251,905; 3,639,521; and 4,208,356.

Conjugated dienes that may be utilized to prepare the polymers and copolymers are those containing from 4 to about 10 carbon atoms and more generally, from 4 to 6 carbon atoms. Examples include from 1,3-butadiene, 2-methyl-1,3-butadiene(isoprene), 2,3-dimethyl-1,3-butadiene, chloroprene, 1,3-pentadiene, 1,3-hexadiene, etc. Mixtures of these conjugated dienes also may be used.

Examples of vinyl aromatic hydrocarbons which may be utilized to prepare the copolymers include styrene and the various substituted styrenes such as o-methylstyrene, p-methylstyrene, p-tert-butylstyrene, 1,3-dimethylstyrene, alpha-methylstyrene, beta-methylstyrene, p-isopropylstyrene, 2,3-dimethylstyrene, o-chlorostyrene, p-chlorostyrene, o-bromostyrene, 2-chloro-4-methylstyrene, etc.

Many of the above-described copolymers of conjugated dienes and vinyl aromatic compounds are commercially available. The number average molecular weight of the block copolymers, prior to hydrogenation, is from about 20,000 to about 500,000, or from about 40,000 to about 300,000.

The average molecular weights of the individual blocks within the copolymers may vary within certain limits. In most instances, the vinyl aromatic block will have a number average molecular weight in the order of about 2000 to about 125,000, or between about 4000 and 60,000. The conjugated diene blocks either before or after hydrogenation will have number average molecular weights in the order of about 10,000 to about 450,000, or from about 35,000 to 150,000.

Also, prior to hydrogenation, the vinyl content of the conjugated diene portion generally is from about 10% to about 80%, or from about 25% to about 65%, particularly 35% to 55% when it is desired that the modified block copolymer exhibit rubbery elasticity. The vinyl content of the block copolymer can be measured by means of nuclear magnetic resonance.

Specific examples of diblock copolymers include styrene-butadiene (SB), styrene-isoprene (SI), and the hydrogenated derivatives thereof. Examples of triblock polymers include styrene-butadiene-styrene (SBS), styrene-isoprene-styrene (SIS), alpha-methylstyrene-butadiene-alpha-methylstyrene, and alpha-methylstyrene-isoprene alpha-methylstyrene. Examples of commercially available block copolymers useful as the adhesives in the present invention include those available from Kraton Polymers LLC under the KRATON trade name.

Upon hydrogenation of the SBS copolymers comprising a rubbery segment of a mixture of 1,4 and 1,2 isomers, a styrene-ethylene-butylene styrene (SEBS) block copolymer is obtained. Similarly, hydrogenation of an SIS polymer yields a styrene-ethylene propylene-styrene (SEPS) block copolymer.

The selective hydrogenation of the block copolymers may be carried out by a variety of well known processes including hydrogenation in the presence of such catalysts as Raney nickel, noble metals such as platinum, palladium, etc., and soluble transition metal catalysts. Suitable hydrogenation processes which can be used are those wherein the diene-containing polymer or copolymer is dissolved in an inert hydrocarbon diluent such as cyclohexane and hydrogenated by reaction with hydrogen in the presence of a soluble hydrogenation catalyst. Such procedures are described in U.S. Pat. Nos. 3,113,986 and 4,226,952. Such hydrogenation of the block copolymers which are carried out in a manner and to extent as to produce selectively hydrogenated copolymers having a residual unsaturation content in the polydiene block of from about 0.5% to about 20% of their original unsaturation content prior to hydrogenation.

In one embodiment, the conjugated diene portion of the block copolymer is at least 90% saturated and more often at least 95% saturated while the vinyl aromatic portion is not significantly hydrogenated. Particularly useful hydrogenated block copolymers are hydrogenated products of the block copolymers of styrene-isoprene-styrene such as a styrene-(ethylene/propylene)-styrene block polymer. When a polystyrene-polybutadiene-polystyrene block copolymer is hydrogenated, it is desirable that the 1,2-polybutadiene to 1,4-polybutadiene ratio in the polymer is from about 30:70 to about 70:30. When such a block copolymer is hydrogenated, the resulting product resembles a regular copolymer block of ethylene and 1-butene (EB). As noted above, when the conjugated diene employed as isoprene, the resulting hydrogenated product resembles a regular copolymer block of ethylene and propylene (EP).

A number of selectively hydrogenated block copolymers are available commercially from Kraton Polymers under the general trade designation "Kraton G." One example is Kraton G1652 which is a hydrogenated SBS triblock comprising about 30% by weight of styrene end blocks and a midblock which is a copolymer of ethylene and 1-butene (EB). A lower molecular weight version of G1652 is available under the designation Kraton G1650. Kraton G1651 is another SEBS block copolymer which contains about 33% by weight of styrene. Kraton G1657 is an SEBS diblock copolymer which contains about 13% w styrene. This styrene content is lower than the styrene content in Kraton G1650 and Kraton G1652.

In another embodiment, the selectively hydrogenated block copolymer is of the formula: $B_n(AB)_oA_p$ wherein n=0 or 1; o is 1 to 100; p is 0 or 1; each B prior to hydrogenation is predominantly a polymerized conjugated diene hydrocarbon block having a number average molecular weight of about 20,000 to about 450,000; each A is predominantly a polymerized vinyl aromatic hydrocarbon block having a number average molecular weight of from about 2000 to about 115,000; the blocks of A constituting about 5% to about 95% by weight of the copolymer; and the unsaturation of the block B is less than about 10% of the original unsaturation. In other embodiments, the unsaturation of block B is reduced upon hydrogenation to less than 5% of its original value, and the average unsaturation of the hydrogenated block copolymer is reduced to less than 20% of its original value.

The block copolymers may also include functionalized polymers such as may be obtained by reacting an alpha, beta-olefinically unsaturated monocarboxylic or dicarboxylic acid reagent onto selectively hydrogenated block copolymers of vinyl aromatic hydrocarbons and conjugated dienes as described above. The reaction of the carboxylic acid reagent in the graft block copolymer can be effected in solutions or by a melt process in the presence of a free radical initiator.

The preparation of various selectively hydrogenated block copolymers of conjugated dienes and vinyl aromatic hydrocarbons which have been grafted with a carboxylic acid reagent is described in a number of patents including U.S. Pat. Nos. 4,578,429; 4,657,970; and 4,795,782, and the disclosures of these patents relating to grafted selectively hydrogenated block copolymers of conjugated dienes and vinyl aromatic compounds, and the preparation of such compounds. U.S. Pat. No. 4,795,782 describes and gives examples of the preparation of the grafted block copolymers by the solution process and the melt process. U.S. Pat. No. 4,578,429 contains an example of grafting of Kraton G1652 (SEBS) polymer with maleic anhydride with 2,5-dimethyl-2,5-di(t-butylperoxy) hexane by a melt reaction in a twin screw extruder.

Examples of commercially available maleated selectively hydrogenated copolymers of styrene and butadiene include Kraton FG1901X, FG1921X, and FG1924X, often referred to as maleated selectively hydrogenated SEBS copolymers. FG1901X contains about 1.7% by weight bound functionality as succinic anhydride and about 28% by weight of styrene. FG1921X contains about 1% by weight of bound functionality as succinic anhydride and 29% by weight of styrene. FG1924X contains about 13% styrene and about 1% bound functionality as succinic anhydride.

Useful block copolymers also are available from Nippon Zeon Co., 2-1, Marunochi, Chiyoda-ku, Tokyo, Japan. For example, Quintac 3530 is available from Nippon Zeon and is believed to be a linear styrene-isoprene-styrene block copolymer.

Unsaturated elastomeric polymers and other polymers and copolymers which are not inherently tacky can be rendered tacky when compounded with an external tackifier. Tackifiers, are generally hydrocarbon resins, wood resins, rosins, rosin derivatives, and the like, which when present in concentrations ranging from about 40% to about 90% by weight of the total adhesive composition, or from about 45% to about 85% by weight, impart pressure sensitive adhesive characteristics to the elastomeric polymer adhesive formulation. Compositions containing less than about 40% by weight of tackifier additive do not generally show sufficient "quickstick," or initial adhesion, to function as a pressure sensitive adhesive, and therefore are not inherently tacky. Compositions with too high a concentration of tackifying additive, on the other hand, generally show too little cohesive strength to work properly in most intended use applications of constructions made in accordance with the instant invention.

It is contemplated that any tackifier known by those of skill in the art to be compatible with elastomeric polymer compositions may be used with the present embodiment of the invention. One such tackifier, found useful is Wingtak 10, a synthetic polyterpene resin that is liquid at room temperature, and sold by the Goodyear Tire and Rubber Company of Akron, Ohio. Wingtak 95 is a synthetic tackifier resin also available from Goodyear that comprises predominantly a polymer derived from piperylene and isoprene. Other suitable tackifying additives may include Escorez 1310, an aliphatic hydrocarbon resin, and Escorez 2596, a $C_5$ to $C_9$ (aromatic modified aliphatic) resin, both manufactured by Exxon of Irving, Tex. Of course, as can be appreciated by those of skill in the art, a variety of different tackifying additives may be used to practice the present invention.

In addition to the tackifiers, other additives may be included in the PSAs to impart desired properties. For example, plasticizers may be included, and they are known to decrease the glass transition temperature of an adhesive composition containing elastomeric polymers. An example of a useful plasticizer is Shellflex 371, a naphthenic processing oil available from Shell Lubricants of Texas. Antioxidants also may be included in the adhesive compositions. Suitable antioxidants include Irgafos 168 and Irganox 565 available from Ciba-Geigy, Hawthorne, N.Y. Cutting agents such as waxes and surfactants also may be included in the adhesives.

The pressure sensitive adhesive may be applied from a solvent, emulsion or suspension, or as a hot melt. The adhesive may be applied to the inner surface of the shrink film by any known method. For example, the adhesive may be applied by die coating curtain coating, spraying, dipping, rolling, gravure or flexographic techniques. The adhesive may be applied to the shrink film in a continuous layer, a discontinuous layer or in a pattern. The pattern coated adhesive layer substantially covers the entire inner surface of the film. As used herein, "substantially covers" is intended to mean the pattern in continuous over the film surface, and is not intended to include adhesive applied only in a strip along the leading or trailing edges of the film or as a "spot weld" on the film.

In one embodiment, an adhesive deadener is applied to portions of the adhesive layer to allow the label to more readily adhere to complex shaped articles. In one embodiment, non-adhesive material such as ink dots or microbeads are applied to at least a portion of the adhesive surface to allow the adhesive layer to slide on the surface of the article as the label is being applied and/or to allow air trapped at the interface between the label and the article to escape.

A single layer of adhesive may be used or multiple adhesive layers may be used. Depending on the shrink film used and the article or container to which the label is to be applied, it may be desirable to use a first adhesive layer adjacent to the shrink film and a second adhesive layer having a different composition on the surface to be applied to the article or container for sufficient tack, peel strength and shear strength.

In one embodiment, the pressure sensitive adhesive has sufficient shear or cohesive strength to prevent excessive shrink-back of the label where adhered to the article upon the action of heat after placement of the label on the article, sufficient peel strength to prevent the film from label from lifting from the article and sufficient tack or grab to enable adequate attachment of the label to the article during the labeling operation. In one embodiment, the adhesive moves with the label as the shrink film shrinks upon the application of heat. In another embodiment, the adhesive holds the label in position so that as the shrink film shrinks, the label does not move.

The heat shrinkable film may include other layers in addition to the monolayer or multilayer heat shrinkable polymeric film. In one embodiment, a metalized coating of a thin metal film is deposited on the surface of the polymeric film. The heat shrinkable film may also include a print layer on the polymer film. The print layer may be positioned between the heat shrink layer and the adhesive layer, or the print layer may be on the outer surface of the shrink layer. In one embodiment, the film is reverse printed with a design, image or text so that the print side of the skin is in direct contact with the container to which the film is applied. In this embodiment, the film is transparent.

The labels of the present invention may also contain a layer of an ink-receptive composition that enhances the printability of the polymeric shrink layer or metal layer if present, and the quality of the print layer thus obtained. A variety of such compositions are known in the art, and these compositions generally include a binder and a pigment, such as silica or talc, dispersed in the binder. The presence of the pigment decreases the drying time of some inks. Such ink-receptive compositions are described in U.S. Pat. No. 6,153,288.

The print layer may be an ink or graphics layer, and the print layer may be a mono-colored or multi-colored print layer depending on the printed message and/or the intended pictorial design. These include variable imprinted data such as serial numbers, bar codes, trademarks, etc. The thickness of the print layer is typically in the range of about 0.5 to about 10 microns, and in one embodiment about 1 to about 5 microns, and in another embodiment about 3 microns. The inks used in the print layer include commercially available water-based, solvent-based or radiation-curable inks. Examples of these inks include Sun Sheen (a product of Sun Chemical identified as an alcohol dilutable polyamide ink), Suntex MP (a product of Sun Chemical identified as a solvent-based ink formulated for surface printing acrylic coated substrates, PVDC coated substrates and polyolefin films), X-Cel (a product of Water Ink Technologies identified as a water-based film ink for printing film substrates), Uvilith AR-109 Rubine Red (a product of Daw Ink identified as a UV ink) and CLA91598F (a product of Sun Chemical identified as a multibond black solvent-based ink).

In one embodiment, the print layer comprises a polyester/vinyl ink, a polyamide ink, an acrylic ink and/or a polyester ink. The print layer may be formed in the conventional manner by, for example, gravure, flexographic or UV flexographic printing or the like, an ink composition comprising a resin of the type described above, a suitable pigment or dye and one or more suitable volatile solvents onto one or more desired areas of the film. After application of the ink composition, the volatile solvent component(s) of the ink composition evaporate(s), leaving only the non-volatile ink components to form the print layer.

The adhesion of the ink to the surface of the polymeric shrink film or metal layer if present can be improved, if necessary, by techniques well known to those skilled in the art. For example, as mentioned above, an ink primer or other ink adhesion promoter can be applied to the metal layer or the polymeric film layer before application of the ink. Alternatively the surface of the polymeric film can be corona treated or flame treated to improve the adhesion of the ink to the polymeric film layer.

Useful ink primers may be transparent or opaque and the primers may be solvent based or water-based. In one embodiment, the primers are radiation curable (e.g., UV). The ink primer may comprise a lacquer and a diluent. The lacquer may be comprised of one or more polyolefins, polyamides, polyesters, polyester copolymers, polyurethanes, polysulfones, polyvinylidine chloride, styrene-maleic anhydride copolymers, styrene-acrylonitrile copolymers, ionomers based on sodium or zinc salts or ethylene methacrylic acid, polymethyl methacrylates, acrylic polymers and copolymers, polycarbonates, polyacrylonitriles, ethylene-vinyl acetate copolymers, and mixtures of two or more thereof. Examples of the diluents that can be used include alcohols such as ethanol, isopropanol and butanol; esters such as ethyl acetate, propyl acetate and butyl acetate; aromatic hydrocarbons such as toluene and xylene; ketones such as acetone and methyl ethyl ketone; aliphatic hydrocarbons such as heptane; and mixtures thereof. The ratio of lacquer to diluent is dependent on the viscosity required for application of the ink primer, the selection of such viscosity being within the skill of the art. The ink primer layer may have a thickness of from about 1 to about 4 microns or from about 1.5 to about 3 microns.

A transparent polymer protective topcoat or overcoat layer may be present in the labels applied in accordance with the invention. The protective topcoat or overcoat layer provide desirable properties to the label before and after the label is affixed to a substrate such as a container. The presence of a transparent topcoat layer over the print layer may, in some embodiments provide additional properties such as antistatic properties stiffness and/or weatherability, and the topcoat may protect the print layer from, e.g., weather, sun, abrasion, moisture, water, etc. The transparent topcoat layer can enhance the properties of the underlying print layer to provide a glossier and richer image. The protective transparent protective layer may also be designed to be abrasion resistant, radiation resistant (e.g., UV), chemically resistant, thermally resistant thereby protecting the label and, particularly the print layer from degradation from such causes. The protective overcoat may also contain antistatic agents, or anti-block agents to provide for easier handling when the labels are being applied to containers at high speeds. The protective layer may be applied to the print layer by techniques known to those skilled in the art. The polymer film may be deposited from a solution, applied as a preformed film (laminated to the print layer), etc.

When a transparent topcoat or overcoat layer is present, it may have a single layer or a multilayered structure. The thickness of the protective layer is generally in the range of about 12.5 to about 125 microns, and in one embodiment about 25 to about 75 microns. Examples of the topcoat layers are described in U.S. Pat. No. 6,106,982.

The protective layer may comprise polyolefins, thermoplastic polymers of ethylene and propylene, polyesters, polyurethanes, polyacryls, polymethacryls, epoxy, vinyl acetate homopolymers, co- or terpolymers, ionomers, and mixtures thereof.

The transparent protective layer may contain UV light absorbers and/or other light stabilizers. Among the UV light absorbers that are useful are the hindered amine absorbers available from Ciba Specialty Chemical under the trade designations "Tinuvin". The light stabilizers that can be used include the hindered amine light stabilizers available from Ciba Specialty Chemical under the trade designations Tinuvin 111, Tinuvin 123, (bis-(1-octyloxy-2,2,6,6-tetramethyl-4-piperidinyl) sebacate; Tinuvin 622, (a dimethyl succinate polymer with 4-hydroxy-2,2,6,6-tetramethyl-1-piperidniethanol); Tinuvin 770 (bis-(2,2,6,6-tetramethyl-4-piperidinyl)-sebacate); and Tinuvin 783. Additional light stabilizers include the hindered amine light stabilizers available from Ciba Specialty Chemical under the trade designation "Chemassorb", especially Chemassorb 119 and Chemassorb 944. The concentration of the UV light absorber and/or light stabilizer is in the range of up to about 2.5% by weight, and in one embodiment about 0.05% to about 1% by weight.

The transparent protective layer may contain an antioxidant. Any antioxidant useful in making thermoplastic films can be used. These include the hindered phenols and the organo phosphites. Examples include those available from Ciba Specialty Chemical under the trade designations Irganox 1010, Irganox 1076 or Irgafos 168. The concentration of the antioxidant in the thermoplastic film composition may be in the range of up to about 2.5% by weight, and in one embodiment about 0.05% to about 1% by weight.

A release liner may be adhered to the adhesive layer to protect the adhesive layer during transport, storage and handling prior to application of the label to a substrate. The liner allows for efficient handling of an array of individual labels after the labels are die cut and the matrix is stripped from the layer of facestock material and up to the point where the individual labels are dispensed in sequence on a labeling line. The release liner may have an embossed surface and/or have non-adhesive material, such as microbeads or printed ink dots, applied to the surface of the liner.

Label Applicator Systems

The preferred label applicator systems in accordance with the present invention generally comprise a first assembly of a belt and a collection of rollers, and a corresponding second assembly of a belt and a collection of rollers. In each of the first and second assemblies, the belt extends around at least some of the rollers and preferably, around all of the rollers. The first and the second assemblies are arranged relative to one another such that a portion of the first belt and a portion of the second belt are generally aligned with one another to define an article receiving lane between the portion of the first belt and the portion of the second belt. In accordance with a significant feature of the present invention, the lane extends in at least two different directions. Typically, the number of occurrences in change in direction of the lane ranges from at least two to six or more, hence the term "zig-zag" configuration is used to refer to the configuration resulting from the arrangement of the first and second assemblies of belts and rollers.

Preferably, each of the first and second assemblies is similar to one another and utilize the same number and types of belts and rollers. Most preferably, the two assemblies are symmetrical with respect to one another as explained herein. However, it will be appreciated that in no way is the invention limited to the use of symmetrical assemblies. Instead, the invention includes the use of assemblies that are non-symmetrical and/or different from one another.

Each assembly preferably comprises a collection of rollers that includes at least one drive roller and at least two lane-defining rollers. Thus, the first assembly includes one or more drive rollers and at least two lane-defining rollers. And the second assembly includes one or more drive rollers and at least two lane-defining rollers.

Preferably, the two assemblies are arranged such that one of the lane-defining rollers of the first assembly is positioned between two of the lane-defining rollers of the second assembly; and one of the lane-defining rollers of the second assembly is positioned between two of the lane-defining rollers of the first assembly. However, it will be appreciated that the present invention includes a wide range of other arrangements and configurations for the assemblies and/or their various rollers and belts.

As noted, upon appropriate arrangement of the first and second assemblies, an article receiving lane is defined between portions of the belts of the two assemblies. The lane includes an article entrance location generally upstream in the resulting system and a corresponding article exit location downstream. The lane preferably is formed or otherwise defined between portions of two belts. As explained in greater detail herein, the belts are arranged relative to one another such that upon motion of the belts, once an article is brought into contact between the belts, the article is contacted by belts on opposing sides of the article. The belts each exhibit a deformable characteristic along their article-contacting face. Preferably, the belt portions forming the lane are generally parallel to one another and spaced apart such that areas of the belts contacting the article are deformed, thereby engaging and retaining the article captured therebetween.

In a preferred aspect, the lane undergoes at least two changes in direction as previously noted, and thus is generally described herein as having a zig-zag configuration. The extent of directional change can be expressed relative to an axis along which the lane-defining rollers are positioned. Preferably, each change in direction ranges from about 5° to about 45°, more preferably from about 10° to about 35°, and most preferably from about 20° to about 25°. Preferably, the lane undergoes alternating changes in direction and so the net change in direction over the entire lane is typically less than 10°. Most preferably, the total angular change in direction that the lane undergoes between the article entrance location and the article exit location sums to less than 5°. For example, if the lane undergoes a first change in direction of 30° and then a second change in direction of −30° (the negative sign denoting that the second change in direction is opposite that of the first change in direction), then the net change in direction is 0°. Thus, articles exiting the lane are traveling in generally the same direction as they were traveling upon initially entering the lane. However, it will be understood that the present invention includes systems in which articles exiting the lane are traveling in a significantly different direction than the direction of articles entering the lane.

Additional details and aspects are now provided concerning the rollers and belts of the noted assemblies. The rollers are not limited to any particular size or shape. However, generally the rollers are cylindrical in shape and from about 46 cm (about 18 inches) to about 15 cm (about 6 inches), more preferably from about 38 cm (about 15 inches) to about 23 cm (about 9 inches), and most preferably about 30 cm (about 12 inches) in diameter. The rollers are preferably rotatable about a vertical axis, and so their cross sectional shape taken along a horizontal plane is circular. Sufficiently sized rollers, e.g. having diameters of at least about 15 cm (about 6 inches), have been found to protect the belt backing material. If instead relatively small diameter rollers are used, such as having a diameter of less than about 10 cm (about 4 inches), significant stress is placed upon the belt backing material which can lead to material fatigue, excessive wear, and failure of the belt. The height of the rollers is generally greater than the width of the corresponding belt, although the invention includes the use of rollers with significantly different proportions. All rollers in an assembly preferably have the same height. Preferably, the rollers, or at least their outer surface, are formed from durable and wear-resistant materials that exhibit a relatively high degree of engagement upon contact with a belt. As will be appreciated, this characteristic minimizes efficiency losses resulting from slippage between the rollers and belt.

The belts are preferably flexible, strong, durable, and wear-resistant. A multilayer belt construction is preferably used as described in greater detail herein. A significant feature of the belts is that the side of the belt that contacts the article(s) to be directed through the label applicator system, is deformable. Generally, this deformable layer is a flexible cellular material such as a foamed polymeric material. Preferably, the foam is a closed cell foam, and is resistant to relatively high temperatures. The deformable layer is compressible upon application of a force. Preferably, the deformable layer for use in the belts of the present invention system can be compressed to 75% of its uncompressed height upon application of a pressure of from about 13.8 kilopascals (about 2 psi) to about 34.5 kilopascals (about 5 psi). Generally, the deformable layer used in the preferred belts satisfies the requirements of ASTM D-1056 2D1. The deformable layer of the belts preferably, also exhibits a 50% compression set after 22 hours at 100° C. (212° F.), in accordance with ASTM D-1056. The foamed polymeric material can be formed from a medium density silicon based foamed polymer exhibiting relatively high heat resistance. The thickness of the deformable layer may range from about 0.6 cm (about 0.25 inches) to 2.5 cm (about 1.0 inch) thick, with 1.3 cm (0.5 inches) being preferred.

As noted, the belts preferably have a multilayer configuration. The article-contacting side of the belt is deformable as previously described. The roller-contacting side of the belt is flexible, wear-resistant, and exhibits a relatively high tensile strength. The layer providing the roller-contacting side of the belt is generally referred to herein as a belt substrate. The roller-contacting side of the belt or belt substrate is preferably formed from a fiberglass silicon layer. A wide array of belt configurations and constructions can be utilized. Generally, all preferred belts used in the present invention systems include a belt substrate layer for contacting and engaging one or more rollers, and a deformable layer for contacting and engaging article(s) and/or label(s) or other components to be attached. The preferred embodiment belts may also include one or more layers or other components as desired. For example, one or more strength promoting layers may be included in the belts. In addition, if further increased conformance of the belt to article(s) is desired, it is contemplated that additional conformable layers could be incorporated in the belts.

The previously described first and second assemblies of rollers and belts are each independently controllable such that the belt speed of the first assembly can be independently controlled with regard to that of the second assembly, and vice versa. Generally for certain methods and systems described herein, during operation it is preferred that the belt speeds of the two assemblies are identical or at least within 10%, more preferably within 5%, and most preferably within 2% of each other. Belts that are operating at such velocities are referred to herein as having velocities that are "substantially the same." However, the present invention includes operating the two assemblies at different belt velocities. For example, depending upon the application, article configuration, and label placement, the belts of the opposing assemblies can be operated at different speeds. This may be desired, for example, to selectively rotate or partially rotate one or more, or all of the articles traveling between the belts through the lane.

The label applicator system of the present invention preferably includes one or more heaters for heating the label(s) and/or articles or portions thereof. As previously explained, such heating may be utilized to induce shrinking of heat-shrink label material, initiate or accelerate adhesive cure, and/or otherwise promote affixment of the label of interest to an article such as a container. Preferably, heating is provided by radiant heaters such as infrared lamps. The present invention includes other modes of heating such as for example heating by forced hot air and heating by use of electrically resistant elements proximate or in contact with the articles and/or labels. Preferably, one or more heaters are arranged and/or positioned proximate to the belts such that the belts reach a steady-state temperature as measured proximate the article entrance location of the lane during operation of the assemblies of at least 50° C. (122° F.). This temperature ensures that for a typical residence time of article and label in the system and for a typical heat activated label or adhesive, the articles and/or labels are sufficiently heated. It will be appreciated that the particular temperature to which the belts, articles, and/or labels are heated will vary depending upon the particular process, label, and/or adhesive requirements.

The present invention is not limited to assemblies of rollers and belts arranged to provide a zig-zag configuration for the lane. Instead, although less preferred, the present invention includes a system of two or more assemblies in which the portions of opposed belts are oriented parallel to one another or substantially so to define relatively straight lanes. Moreover, it is also contemplated that arrangements could provide lanes that extended in an arcuate path.

The present invention also provides various methods for applying labels onto articles using the assemblies and systems described herein. Preferably, the methods utilize a system including a first assembly of a first belt extending about a first collection of rollers, and a second assembly of a second belt extending about a second collection of rollers. The first and second assemblies are arranged such that a portion of the first belt and a portion of the second belt are aligned with one another to define an article receiving lane. The method generally comprises initially adhering a label onto an outer surface of an article to receive the label. The method also comprises moving the first belt about the first collection of rollers and moving the second belt about the second collection of rollers such that the first and second belts are generally displaced alongside one another within the lane. And, the method further comprises introducing the article and label initially adhered thereto at a first location in the lane such that the first and second belts contact and transport the article and label to a second location in the lane. The second location is located downstream of the first location. As the article is transported from the first location to the second location and engaged between the two deformable belts, the label is fully contacted with and applied onto the article.

In the previously described method, the lane may be in a variety of different configurations. For example, the lane may be relatively straight or extend in an arcuate fashion. Most preferably, the lane extends in at least two different directions, i.e. in a zig-zag configuration.

In all of the noted methods, the assemblies are selectively controlled such that the velocity of the belts is controlled. Specifically, depending upon the lane configuration and desired pattern of article movement through the lane, the velocities of the belts can be controlled so as to be different or to be the same or substantially the same as one another.

Furthermore, in all of the methods, one or more heating operations can be undertaken to provide specified amounts of heat to the belts, articles, and/or labels prior to or during label application.

FIGS. 1-5 illustrate a preferred embodiment system in accordance with the present invention. Specifically, the preferred system 1 comprises a first assembly 10 and a second assembly 110 arranged and configured as follows. The first assembly 10 includes a drive roller 20 and two or more lane-defining rollers 30*a* and 30*b*. The first assembly 10 may also optionally include one or more secondary rollers 40, such as 40*a* and 40*b*. The first assembly 10 includes a belt 50 extending about the collection of rollers 20, 30*a*, 30*b*, 40*a*, and 40*b*.

The second assembly 110 includes a drive roller 120 and two or more lane-defining rollers 130*a* and 130*b*. The second assembly 110 may also optionally include one or more secondary rollers 140, such as 140*a* and 140*b*. The second assembly 110 includes a belt 150 extending about the collection of rollers 120, 130*a*, 130*b*, 140*a*, and 140*b*.

Referring further to FIG. 1, it will be understood that the two assemblies 10 and 110 are arranged such that a portion of the first belt 50 extends alongside a portion of the second belt 150 to thereby define an article receiving lane. The article receiving lane is shown in FIG. 1 as extending between the assemblies 10 and 110 generally in the direction of arrows A and B. The assemblies 10 and 110 are operated such that their respective belts move around their corresponding collections of rollers in opposite directions. This results in the belt portions defining the lane, moving alongside one another in generally the same direction. In FIG. 1, the belt 50 of the first assembly 10 is displaced about the collection of rollers 20, 30*a*, 30*b*, 40*a*, and 40*b*, in the direction of arrow C. The belt 150 of the second assembly 110 is displaced about the collection of rollers 120, 130*a*, 130*b*, 140*a*, and 140*b*, in the direction of arrow D. Thus, the belts generally travel alongside one another within the lane, extending from an article receiving location proximate arrow A to an article exit location proximate arrow B.

Figure 2:
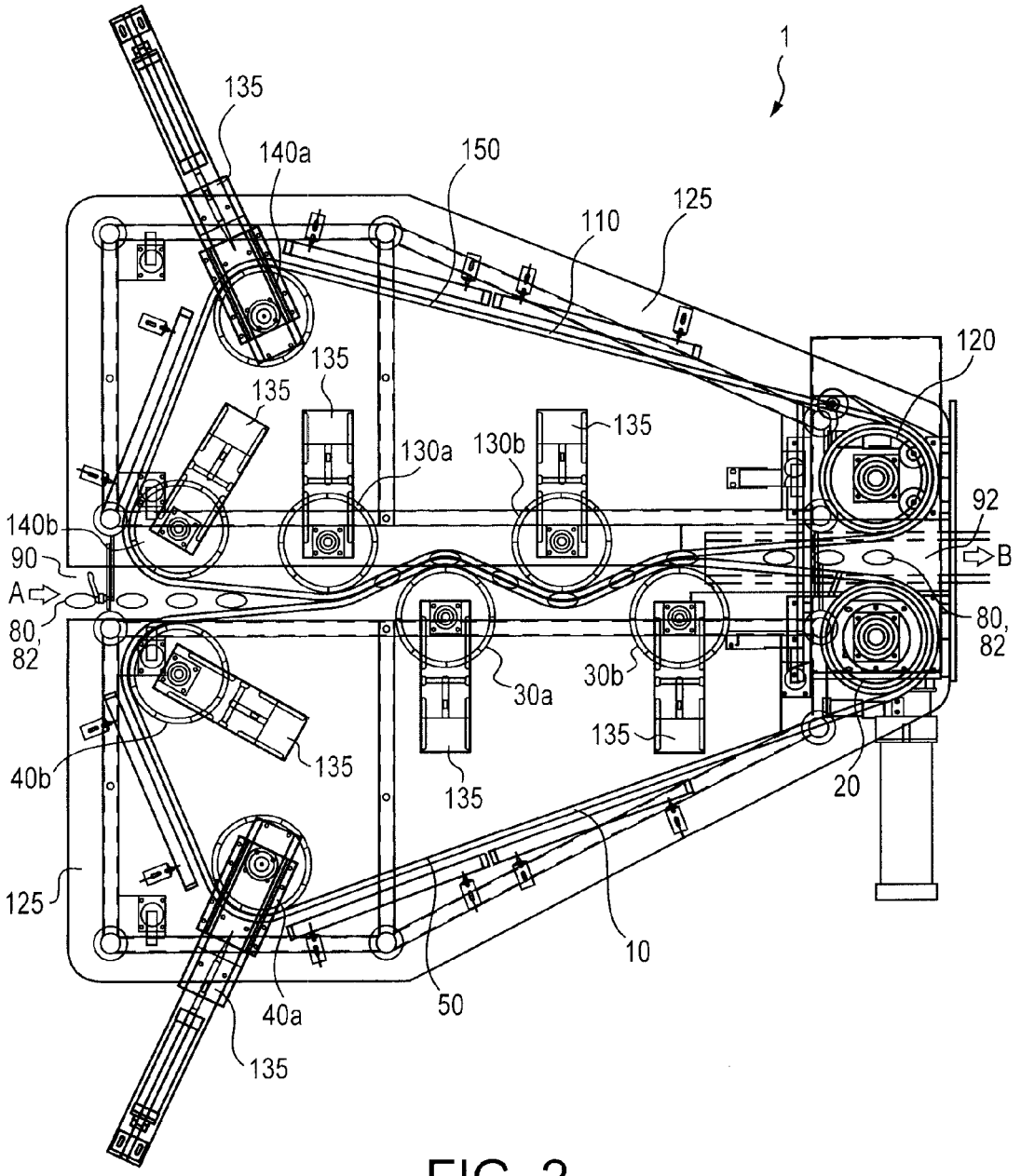
FIG. 2 is a top plan view of the preferred embodiment system depicted in FIG. 1.

FIG. 2 is a top plan view of the preferred embodiment system 1 illustrating a collection of articles 80 and labels 82 each partially adhered to a corresponding article 80 at an article entrance location 90 and the articles 80 and labels 82 each fully adhered to a corresponding article 80 at an article exit location 92. It will be appreciated that one or more conveyors or other article transport systems are preferably utilized to transport the articles 80 and labels 82 to the entrance location 90 and from the exit location 92.

Referring further to FIG. 2, the system 1 may include additional features as follows. Each of the lane-defining rollers such as rollers 30*a* and 30*b* of the first assembly 10 and rollers 130*a* and 130*b* of the second assembly 110, is provided with a positioning adjustment component, generally designated as 135. The positioning adjustment component 135 is configured to primarily move its respective roller in a direction perpendicular to the rotational axis of the roller. However, other aspects of positioning are provided as described in greater detail herein. As will be appreciated, such displacement of a roller serves to alter the path of the belt and/or change the belt tension.

The system 1 is depicted in FIG. 2 as disposed upon a frame assembly, generally denoted as 125. It will be appreciated that in no event is the system of the invention limited to such a configuration. For example, the present invention readily includes systems that are arranged directly upon floor surfaces and thus which do not include elevated frame assemblies such as 125.

Figure 3:
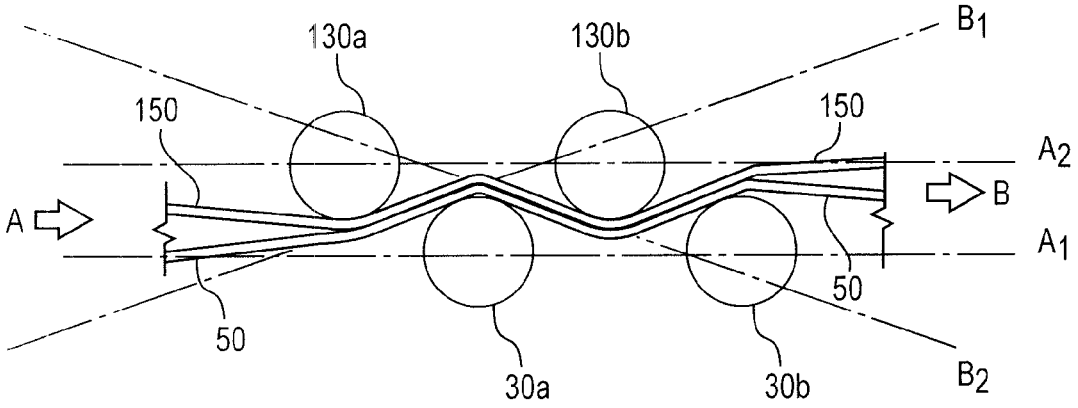
FIG. 3 is a partial schematic view of the roller and belt arrangement used in the system illustrated in FIG. 2.

FIG. 3 is a partial schematic view of two lane-defining rollers of assemblies 10 and 110, and belts 50 and 150 extending therebetween. FIG. 3 further illustrates various preferred aspects of the zig-zag configuration described herein. Specifically, it will be noted that the rollers 30*a* and 30*b* are positioned relative to one another such that their respective axes of rotation are defined along a roller axis $A_1$. And, the rollers 130*a* and 130*b* are positioned relative to one another such that their respective axes of rotation are defined along a roller axis $A_2$. As described herein, the belts 50 and 150 extend through the lane-defining rollers in alternating different directions. Specifically, as the belts 50 and 150 travel from arrow A to arrow B, upon contact, direct and indirect, with the roller 130*a*; the belts undergo a change in direction of from about 10° to about 35° and more preferably from about 20° to about 25°. After undergoing the noted directional change, the belts travel in the direction denoted as line $B_1$. Thus, the angular change from axis $A_2$ to line $B_1$ is from about 10° to about 35° and more preferably from about 20° to about 25°. The belts continue to travel until they contact, indirectly and directly, roller 30*a*. The belts 50 and 150 then undergo another change in direction, preferably in an opposite direction from the previous change in direction. Concerning the extent of angular change in direction, after the belts 50 and 150 revert back to a direction parallel with the roller axis $A_1$, preferably, the belts undergo a further change in direction to an extent that is equal to the previous change in direction, i.e. from about 10° to about 35° and most preferably from about 20° to about 25°. The belts then travel from roller 30*a* to then contact, directly and indirectly, roller 130*b* at which the previous process is repeated. This pattern of alternating changes in direction is the noted zig-zag configuration.

Figure 4:
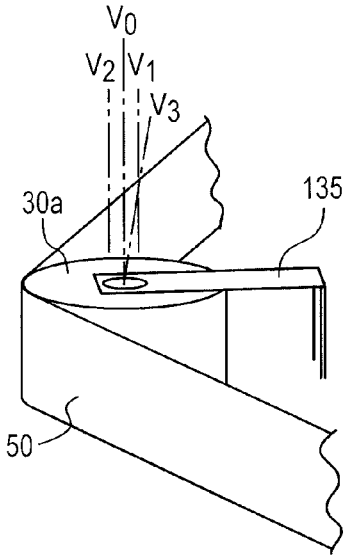
FIG. 4 is a detailed perspective view of a roller and belt portion used in the preferred system depicted in FIG. 1.

FIG. 4 is a detailed view of a typical roller and its engagement with a belt, such as a lane-defining roller 30*a* and the first belt 50. The previously noted positioning adjustment component 135 is configured to provide selective adjustment of the location of the rotational axis of the roller. For example, the component 135 can be selectively adjusted to change the roller rotational axis from $V_0$ to $V_1$ in order to reduce belt tension, or to change $V_0$ to $V_2$ in order to increase belt tension. Component 135 can also be adjusted to change the orientation of the axis such as from $V_0$ to $V_3$. Moreover, component 135 preferably includes one or more biasing members such as springs to exert a predetermined force upon the belt via its engagement with the roller.

Figure 5:
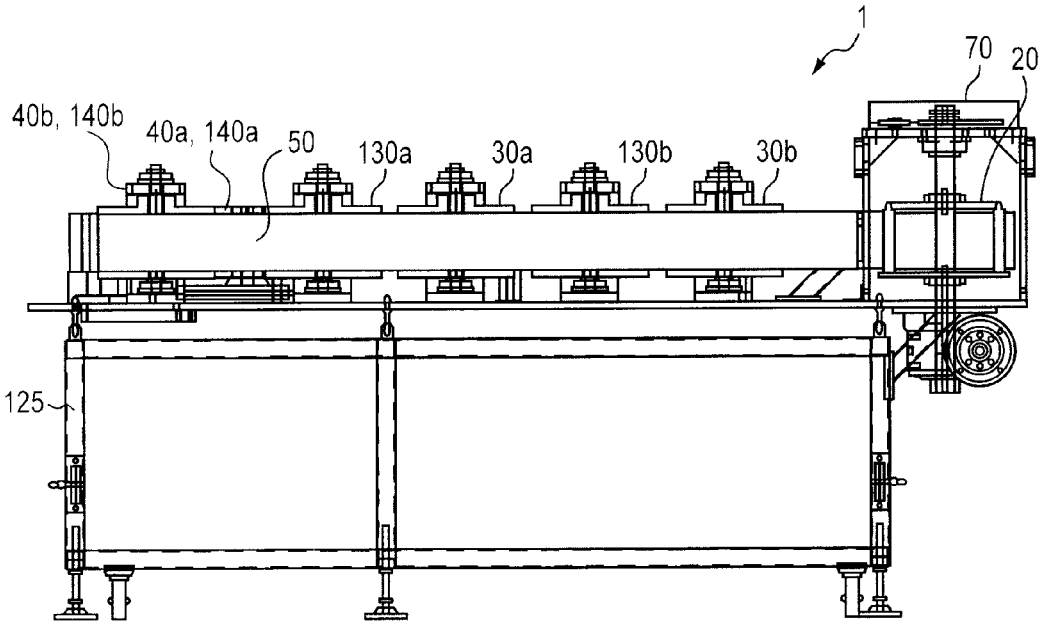
FIG. 5 is a side elevational view of the preferred system depicted in FIGS. 1-2.

FIG. 5 is a side elevational view of the system 1 comprising the first and second assemblies 10 and 110. This figure further illustrates the preferred arrangement of rollers and belts. The frame 125 is further depicted as elevating the system 1. A controller 70 is preferably provided for powering the drive rollers such as roller 20. The controller 70 generally includes one or more electrical motors and corresponding control modules, sensor, and related components as known in the art to provide a selectively adjustable and controllable drive source for at least the drive rollers. The drive system and related controls are provided using known technology and so no further description is provided concerning these aspects.

Figure 6:
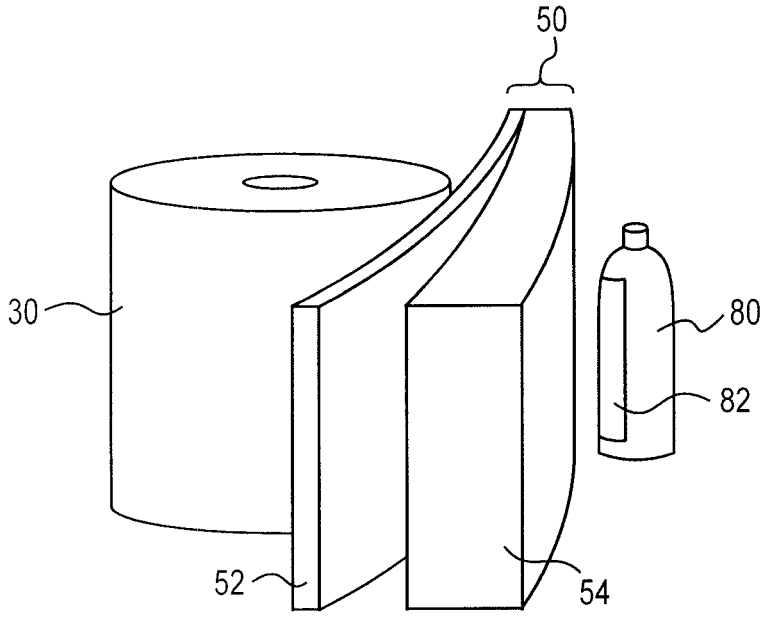
FIG. 6 is a schematic view of a preferred embodiment belt construction used in the present invention system.

FIG. 6 is a schematic view depicting a preferred orientation of a belt relative to a roller and an article and label to be affixed thereto. Specifically, a belt such as belt 50 of the first assembly 10 is shown in an exploded form illustrating a preferred multilayer construction. The belt 50 includes a substrate layer 52 and a deformable layer 54. The belt 50 is oriented relative to a roller such as roller 30, such that the substrate layer 52 of the belt 50 contacts the outer surface of the roller 30. Similarly, the belt 50 also includes a deformable layer 54 that is oriented for contacting one or more article(s) 80 and label(s) 82.

Figure 7:
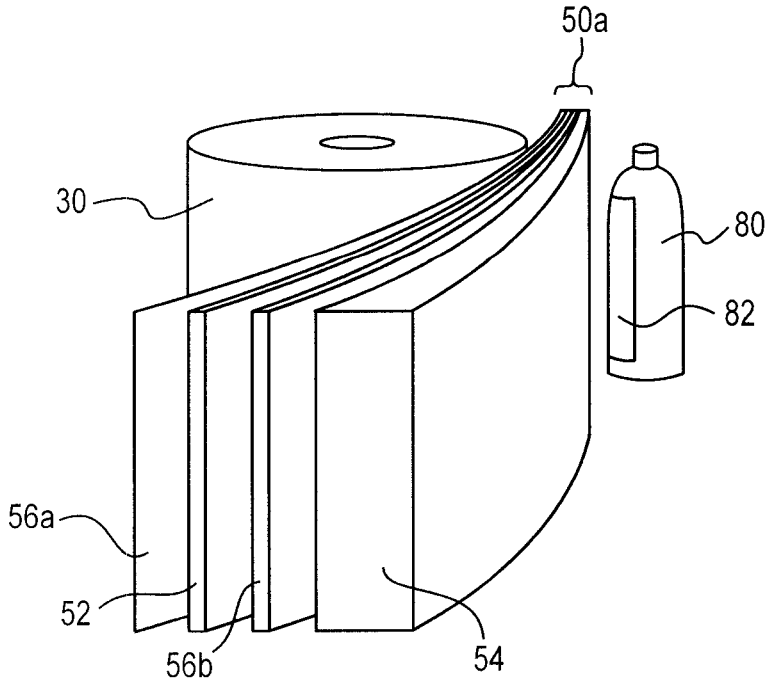
FIG. 7 is a schematic view of another preferred embodiment belt construction used in the present invention system.

The present invention includes additional belt constructions such as the incorporation of one or more additional layers in the belt laminate. For example, FIG. 7 illustrates another belt 50*a* comprising a substrate layer 52, a deformable layer 54, and two secondary layers 56*a* and 56*b*. The secondary layers 56 can be located anywhere in the belt laminate so long as the deformable layer 54 is oriented and exposed for contact with article(s) and label(s).

Figure 8:
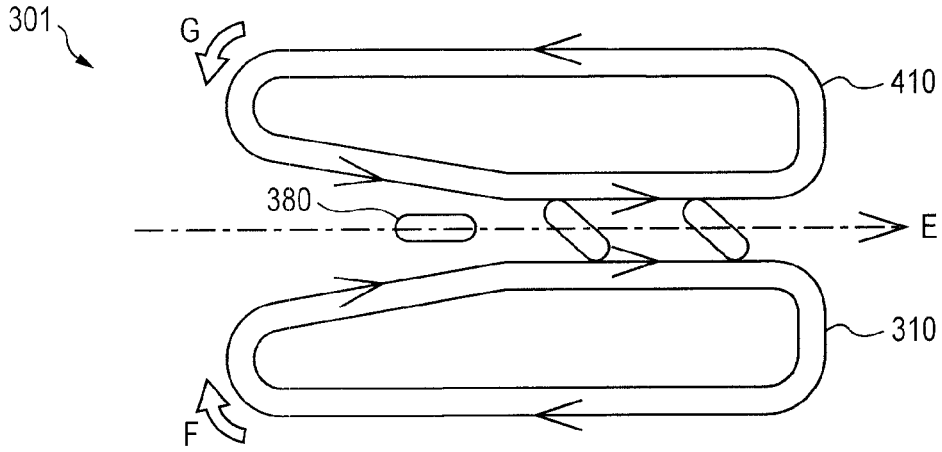
FIGS. 8-10 illustrate another system in accordance with the present invention and several contemplated modes of operation.
Figure 9:
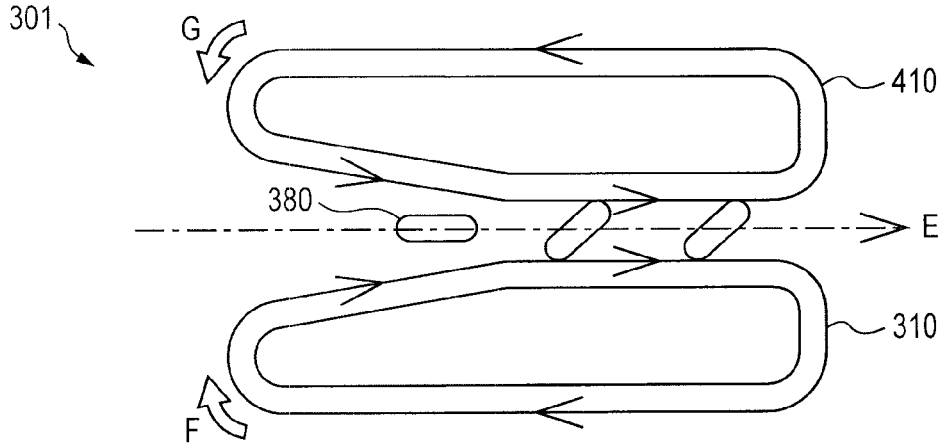
Figure 10:
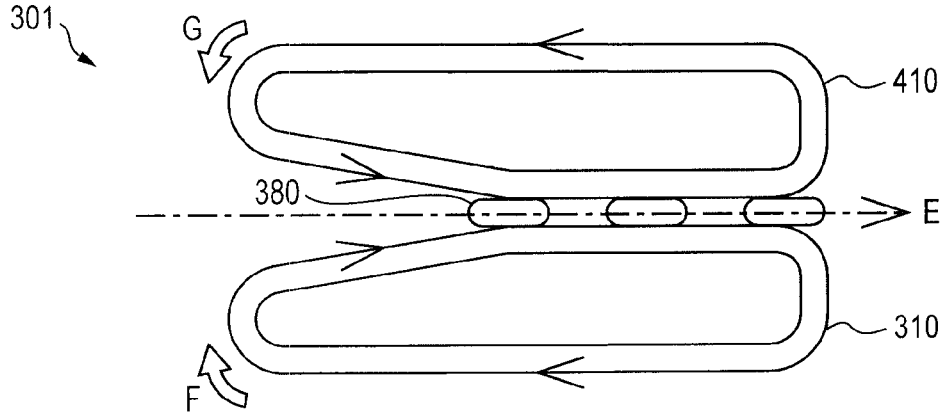

The present invention also includes the use of a wide array of different lane configurations besides the zig-zag configuration depicted in FIGS. 1-3. For example, in certain embodiments, systems may be provided that utilize a relatively straight lane configuration. In this version of the invention, the articles being displaced through the lane can be selectively rotated or otherwise positioned by selectively varying the velocities of the belts of the corresponding assemblies. For example, FIGS. 8-10 schematically illustrate a system 301 comprising a first assembly 310 and a second assembly 410 arranged to form a lane E extending between a portion of the belts of assemblies 310 and 410. A collection of articles 380 is displaced through lane E by contact from the belts moving in the directions of arrows F and G.

Figure 11:
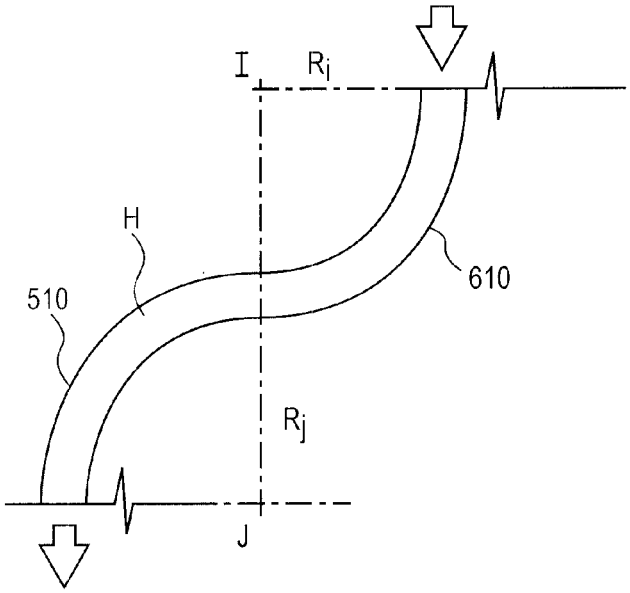
FIGS. 11-12 illustrate additional systems in accordance with the present invention.
Figure 12:
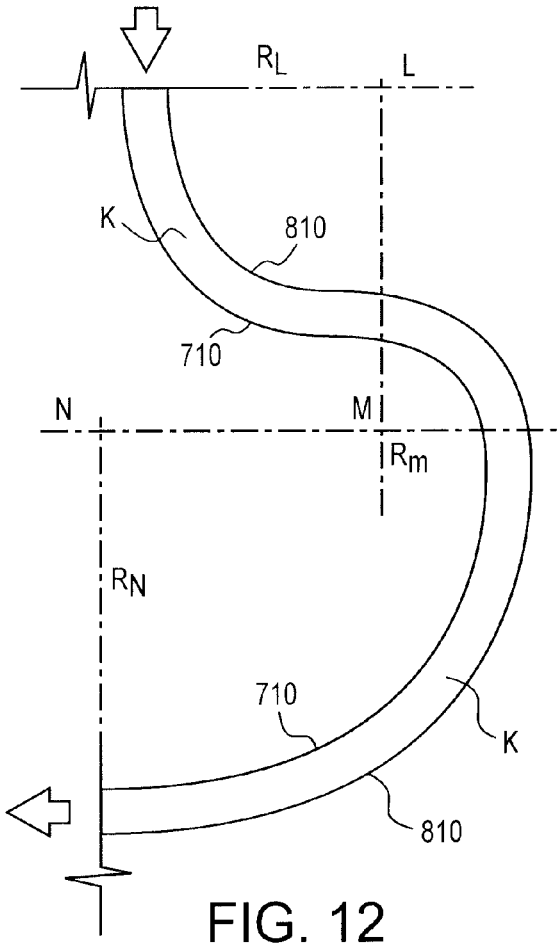

FIGS. 11 and 12 illustrate additional embodiments for lane configurations in accordance with the present invention. Another contemplated lane configuration is an arcuate lane path. For example, in FIG. 11, an arcuate lane H is defined between corresponding belts 510 and 610. The lane H can extend about an arc in either direction or both directions as shown in FIG. 11. The radius of the arc about which the lane H extends can vary depending upon the characteristics of the articles and labels. For lane configurations in which multiple arcuate paths are undertaken by the lane, the radii of the various arcs can be the same as in FIG. 11 where $R_I$ equals $R_J$, or different as depicted in FIG. 12. Specifically, in FIG. 12, an arcuate lane K is defined between corresponding belts 710 and 810. In a first lane segment, the lane K extends through an arc defined by radius $R_L$. In a second lane segment, the lane K extends through an arc defined by radius $R_M$. And in a third lane segment, the lane K extends through an arc defined by radius $R_N$. Radii $R_L$, $R_M$, and $R_N$ are all different from one another.

Furthermore, it will be appreciated that the various arcuate lane configurations are not limited to a lane or lane segment extending through an arc of 90° as shown in FIGS. 11 and 12. Instead, the lane or lane segment(s) may extend through an arc of from about 5° to about 180°, and more preferably from about 45° to about 120°.

Although the present invention and its various preferred embodiments have been described in terms of applying labels, and particularly pressure sensitive shrink labels, onto curved surfaces of containers, and most preferably outwardly extending compound curved surfaces, it will be understood that the present invention is applicable to a host of other operations such as applying labels, films, or other thin flexible members upon other surfaces besides those associated with containers. Moreover, it is also contemplated that the invention can be used to apply such components onto relatively flat planar surfaces.

Additional details associated with applying pressure sensitive labels, and particularly pressure sensitive shrink labels, are provided in WO 2008/124581; US 2009/0038736; and US 2009/0038737.

Many other benefits will no doubt become apparent from future application and development of this technology.

All patents, published applications, and articles noted herein are hereby incorporated by reference in their entirety.

As described hereinabove, the present invention solves many problems associated with previous type devices. However, it will be appreciated that various changes in the details, materials and arrangements of parts, which have been herein described and illustrated in order to explain the nature of the invention, may be made by those skilled in the art without departing from the principle and scope of the invention, as expressed in the appended claims.

What is claimed is:

1. A method of applying labels onto articles using a system including a first assembly of a first belt extending about a first collection of rollers, a second assembly of a second belt extending about a second collection of rollers, the first and second assemblies arranged such that a portion of the first belt and a portion of the second belt are aligned with one another to define an article receiving lane having a region extending in at least two different directions, the method comprising:

initially adhering a label onto an outer surface of an article to receive the label;

moving the first belt about the first collection of rollers and moving the second belt about the second collection of rollers such that the first and second belts are generally displaced alongside one another within the lane;

introducing the article and label initially adhered thereto at a first location in the lane such that the first and second belts contact and transport the article and label to a second location in the lane, the second location being located downstream of the first location and the region of the lane that extends in at least two different directions, whereby as the article is transported from the first location to the second location, the label is fully contacted with and applied onto the article.

2. The method of claim 1 further comprising:

heating at least one of the first belt and the second belt to a temperature of at least 50° C.

3. The method of claim 1 wherein the moving of the first belt and moving of the second belt is performed such that the velocity of the first belt is different than the velocity of the second belt.

4. The method of claim 1 wherein the moving of the first belt and moving of the second belt is performed such that the velocity of the first belt is substantially the same as the velocity of the second belt.

5. A method of applying labels onto articles using a system including a first assembly of a first belt extending about a first collection of rollers, a second assembly of a second belt extending about a second collection of rollers, the first and second assemblies arranged such that a portion of the first belt and a portion of the second belt are aligned with one another to define an article receiving lane extending in an arcuate fashion, the method comprising:

initially adhering a label onto an outer surface of an article to receive the label;

moving the first belt about the first collection of rollers and moving the second belt about the second collection of rollers such that the first and second belts are generally displaced alongside one another within the lane;

introducing the article and label initially adhered thereto at a first location in the lane such that the first and second belts contact and transport the article and label to a second location in the lane, the second location being located downstream of the first location, whereby as the article is transported from the first location to the second location, the label is fully contacted with and applied onto the article.

6. The method of claim 5 further comprising:

heating at least one of the first belt and the second belt to a temperature of at least 50° C.

7. The method of claim 5 wherein the moving of the first belt and moving of the second belt is performed such that the velocity of the first belt is different than the velocity of the second belt.

8. The method of claim 5 wherein the moving of the first belt and moving of the second belt is performed such that the velocity of the first belt is substantially the same as the velocity of the second belt.

9. A method of applying labels onto articles using a system including a first assembly of a first belt extending about a first collection of rollers, a second assembly of a second belt extending about a second collection of rollers, the first and second assemblies arranged such that a portion of the first belt and a portion of the second belt are aligned with one another to define an article receiving lane having a zig-zag configuration, the method comprising:

initially adhering a label onto an outer surface of an article to receive the label;

moving the first belt about the first collection of rollers and moving the second belt about the second collection of rollers such that the first and second belts are generally displaced alongside one another within the lane;

introducing the article and label initially adhered thereto at a first location in the lane such that the first and second belts contact and transport the article and label to a second location in the lane, the second location being located downstream of the first location, whereby as the article is transported from the first location to the second location, the label is fully contacted with and applied onto the article.

10. The method of claim 1, wherein the first collection of rollers includes (i) at least one drive roller and (ii) at least two lane-defining rollers.

11. The method of claim 1, wherein the second collection of rollers includes (i) at least one drive roller and (ii) at least two lane-defining rollers.

12. The method of claim 1, wherein the first collection of rollers includes at least one first drive roller and at least two first lane-defining rollers; and wherein the second collection of rollers includes at least one second drive roller and at least two second lane-defining rollers.

13. The method of claim 12, wherein one of the at least two first lane-defining rollers is disposed between two of the at least two second lane-defining rollers.

14. The method of claim 12, wherein one of the at least two second-lane-defining rollers is disposed between two of the at least two first lane-defining rollers.

15. The method of claim 1, wherein the first belt includes a substrate layer for contacting rollers and a deformable layer for contacting articles.

16. The method of claim 15, wherein the deformable layer comprises a flexible cellular material.

17. The method of claim 16, wherein the flexible cellular material is a foamed polymeric material.

18. The method of claim 16, wherein the flexible cellular material is a closed cell foam.

19. The method of claim 1, wherein the at least two different directions include a first direction and a second direction; wherein an angular change between the first direction and the second direction is from about 10° to about 35°.

20. The method of claim 19, wherein the angular change is from about 20° to about 25°.

21. The method of claim 5, wherein the first collection of rollers includes (i) at least one drive roller and (ii) at least two lane-defining rollers.

22. The method of claim 5, wherein the second collection of rollers includes (i) at least one drive roller and (ii) at least two lane-defining rollers.

23. The method of claim 5, wherein the first collection of rollers includes at least one first drive roller and at least two first lane-defining rollers; and wherein the second collection of rollers includes at least one second drive roller and at least two second lane-defining rollers.

24. The method of claim 1, wherein the article has a compound curved outer surface.

25. The method of claim 1, wherein the article has an outer surface in the shape of a sphere.

26. The method of claim 1, wherein the article has an outer surface in the shape of a hyperbolic paraboloid.

27. The method of claim 1, wherein the article has an outer surface in the shape of a dome.

28. The method of claim 5, wherein the article has a compound curved outer surface.

29. The method of claim 5, wherein the article has an outer surface in the shape of a sphere.

30. The method of claim 5, wherein the article has an outer surface in the shape of a hyperbolic paraboloid.

31. The method of claim 5, wherein the article has an outer surface in the shape of a dome.

32. The method of claim 9, wherein the article has a compound curved outer surface.

33. The method of claim 9, wherein the article has an outer surface in the shape of a sphere.

34. The method of claim 9, wherein the article has an outer surface in the shape of a hyperbolic paraboloid.

35. The method of claim 9, wherein the article has an outer surface in the shape of a dome.

36. The method of claim 5, wherein an arcuate segment of the article receiving lane extends through an arc of 90°.

37. The method of claim 5, wherein an arcuate segment of the article receiving lane extends through an arc of from about 5° to about 180°.

38. The method of claim 5, wherein an arcuate segment of the article receiving lane extends through an arc from about 45° to about 120°.

* * * * *